US007681328B2

(12) United States Patent
DuVal et al.

(10) Patent No.: US 7,681,328 B2
(45) Date of Patent: Mar. 23, 2010

(54) UNIFORM DELIVERY OF COMPOSITIONS

(75) Inventors: Dean Larry DuVal, Lebanon, OH (US); Laura Lynn Heilman, Cincinnati, OH (US); Kofi Ofosu-Asante, Cincinnati, OH (US); Mary Jane Combs, Covington, KY (US); Antony Thanh Nguyen, Cincinnati, OH (US); Eugene Joseph Pancheri, Cincinnati, OH (US); Janine Morgens Strang, Deer Park, OH (US); Janet Sue Littig, Fairfield, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 203 days.

(21) Appl. No.: 11/123,306

(22) Filed: May 6, 2005

(65) Prior Publication Data

US 2005/0251924 A1 Nov. 17, 2005

Related U.S. Application Data

(63) Continuation-in-part of application No. 10/842,926, filed on May 11, 2004, now Pat. No. 7,047,663, which is a continuation-in-part of application No. 10/839,549, filed on May 5, 2004, which is a continuation-in-part of application No. 10/762,152, filed on Jan. 21, 2004, now Pat. No. 7,503,127, which is a continuation-in-part of application No. 10/697,736, filed on Oct. 29, 2003, now abandoned, which is a continuation-in-part of application No. 10/697,734, filed on Oct. 29, 2003, now abandoned, which is a continuation-in-part of application No. 10/697,685, filed on Oct. 29, 2003, now Pat. No. 7,043,855, which is a continuation-in-part of application No. 10/697,735, filed on Oct. 29, 2003, now Pat. No. 7,146,749, which is a continuation-in-part of application No. 10/418,595, filed on Apr. 17, 2003, now Pat. No. 7,059,065.

(60) Provisional application No. 60/374,601, filed on Apr. 22, 2002, provisional application No. 60/426,438, filed on Nov. 14, 2002, provisional application No. 60/568,771, filed on May 6, 2004.

(51) Int. Cl.
*F26B 11/02* (2006.01)

(52) U.S. Cl. ..... 34/597; 34/60

(58) Field of Classification Search ..... 34/595, 34/597, 60, 74; 134/93, 95.3; 68/12.18, 68/12.19

See application file for complete search history.

(56) References Cited

U.S. PATENT DOCUMENTS 2,079,280 A 5/1937 Couch (Continued)

FOREIGN PATENT DOCUMENTS

DE 23 18 596 B2 4/1980

(Continued)

OTHER PUBLICATIONS

Brokaw, Leslie—"Get a Whiff Of This", Inc.com Magazine, Nov. 1988, (1 page) Copyright 2003 Gruner + Jahr USA Publishing, Inc. com, 77 North Washington Street, Boston, MA 02114.

(Continued)

*Primary Examiner*—Jiping Lu
(74) *Attorney, Agent, or Firm*—Julia A. Glazer; Kim W. Zerby; Steven W. Miller

(57) ABSTRACT

A system for uniformly delivering treatment compositions to fabrics in a fabric article drying appliance. The system also provides for efficient delivery of treatment compositions to fabrics in a fabric article drying appliance. A method is also provided for the uniform and efficient delivery of treatment compositions to fabrics in fabric article drying appliances.

5 Claims, 14 Drawing Sheets

U.S. PATENT DOCUMENTS 2,776,557 A * 1/1957 Bruckman ..... 68/12.06
2,807,893 A 10/1957 Morey
2,812,593 A 11/1957 Olthuis
2,846,776 A 8/1958 Clark
2,851,791 A 9/1958 Olthuis
2,873,539 A 2/1959 Morey
2,941,309 A 6/1960 Cobb
2,958,954 A 11/1960 Longenecker
3,002,288 A 10/1961 Coniee
3,022,580 A 2/1962 Doty
3,103,450 A 9/1963 Janson
3,114,653 A 12/1963 Kruzan
3,172,604 A 3/1965 Brock
3,180,037 A 4/1965 Etal
3,239,947 A 3/1966 Etal
3,267,701 A 8/1966 Mandarino
3,364,585 A 1/1968 Etal
3,583,180 A 6/1971 Arbogast
3,595,036 A 7/1971 Laddle
3,634,947 A 1/1972 Furgal
3,730,682 A * 5/1973 Brubaker et al. ..... 134/95.3
3,816,070 A 6/1974 Candor et al.
3,872,604 A 3/1975 Keller
4,009,598 A 3/1977 Bernard et al.
4,014,105 A 3/1977 Furgal et al.
4,022,938 A 5/1977 Zaki et al.
4,098,937 A 7/1978 Mizuno et al.
4,207,683 A 6/1980 Horton
4,236,320 A 12/1980 Schwadike et al.
4,242,377 A 12/1980 Roberts et al.
4,341,347 A 7/1982 DeVittorio
4,501,682 A 2/1985 Goodman et al.
4,511,495 A 4/1985 Melville
4,532,722 A 8/1985 Sax
4,567,675 A 2/1986 Rennie
4,579,279 A 4/1986 Marchant
4,618,099 A 10/1986 Nagao et al.
4,642,908 A 2/1987 Brenner
4,806,254 A 2/1989 Church
4,891,890 A 1/1990 Church
5,040,311 A 8/1991 Roy
5,234,610 A 8/1993 Gardlik et al.
5,438,773 A 8/1995 Chaffee
5,442,938 A 8/1995 Kislyuk
5,445,747 A 8/1995 Kvietok et al.
5,461,742 A 10/1995 Pasad et al.
5,532,023 A 7/1996 Vogel et al.
5,595,071 A 1/1997 Pasad et al.
5,749,163 A 5/1998 Staub et al.
5,771,604 A 6/1998 Wunderlich et al.
5,789,368 A 8/1998 You et al.
5,798,107 A 8/1998 Vogel et al.
5,810,265 A 9/1998 Cornelius et al.
5,884,418 A 3/1999 Mc Nally
5,912,408 A 6/1999 Trinh et al.
5,930,909 A 8/1999 McNally
5,945,111 A 8/1999 Esser
5,965,517 A 10/1999 Mooney
5,966,831 A 10/1999 Anderson
5,968,404 A 10/1999 Trinh et al.
5,980,583 A 11/1999 Staub et al.
5,997,759 A 12/1999 Trinh et al.
6,001,343 A 12/1999 Trinh et al.
6,067,723 A 5/2000 Lafrenz
6,103,678 A 8/2000 Masschelein et al.
6,160,110 A 12/2000 Thomaides et al.
6,277,810 B2 8/2001 Baines et al.
6,279,834 B1 8/2001 Fox et al.
6,315,800 B1 11/2001 Gomes et al.
6,376,455 B1 4/2002 Friedli et al.
6,474,563 B2 11/2002 Pletcher et al.
6,491,840 B1 12/2002 Frankenbach et al.
6,503,413 B2 1/2003 Uchiyama et al.
6,571,993 B2 6/2003 Rodd et al.
6,574,883 B2 6/2003 Giblin et al.
6,604,297 B2 8/2003 Hagemann et al.
6,609,311 B2 8/2003 Hagemann et al.
6,652,766 B1 11/2003 Frankenbach et al.
6,696,405 B2 2/2004 Mooney
6,792,695 B2 9/2004 Fry et al.
6,883,723 B2 4/2005 Griese et al.
6,889,399 B2 5/2005 Steiner et al.
2001/0036909 A1 11/2001 Levinson
2001/0044399 A1 11/2001 Keppie et al.
2001/0052551 A1 12/2001 Pletcher et al.
2001/0052552 A1 12/2001 Hamaguchi et al.
2002/0050073 A1 5/2002 Hagemann et al.
2002/0069465 A1 6/2002 Chute et al.
2002/0078589 A1 6/2002 Hagemann et al.
2002/0083615 A1 7/2002 Giblin et al.
2002/0100122 A1 8/2002 Rodrigues et al.
2002/0112293 A1 8/2002 Trinh et al.
2003/0035748 A1 2/2003 Trinh et al.
2003/0091749 A1* 5/2003 France et al. ..... 68/200
2003/0196348 A1 10/2003 Hagemann et al.
2003/0199416 A1 10/2003 Fry et al.
2003/0199417 A1 10/2003 Fry et al.
2003/0200674 A1 10/2003 Fry et al.
2003/0213145 A1 11/2003 Hagemann et al.
2003/0224965 A1 12/2003 Conley et al.
2004/0025368 A1 2/2004 Gerlach et al.
2004/0064970 A1 4/2004 Hagemann et al.
2004/0118014 A1 6/2004 Burgess et al.
2004/0134094 A1 7/2004 Hahn et al.
2004/0221476 A1 11/2004 Jones et al.
2004/0253376 A1 12/2004 Parker
2005/0020478 A1 1/2005 Cooke et al.
2006/0080860 A1 4/2006 Clark et al.
2006/0162180 A1 7/2006 Heilman et al.
2006/0191157 A1 8/2006 Gerlach et al.

FOREIGN PATENT DOCUMENTS

EP 0 130 682 1/1985
EP 0 118 313 5/1987
EP 0 315 879 B1 5/1989
EP 0 204 484 B1 3/1992
EP 0 594 154 A1 4/1994
EP 0848999 A2 6/1998
EP 0 676 497 B1 9/1999
EP 0 953 669 A2 11/1999
EP 1 479 757 A1 11/2004
GB 2 066 309 A 7/1981
GB 2 231 944 A 11/1990
GB 2 354 006 B 3/2001
GB 2 366 568 A 3/2002
GB 2 346 678 B 10/2002
JP 02-302300 12/1990
JP 06-015090 1/1994
JP 1995068094 A2 3/1995
JP 08-150293 6/1996
JP 1996215488 A 8/1996
JP 09-267000 A 10/1997
JP 10-290898 A 11/1998
JP 2002069832 A2 3/2002
JP 2002115182 A 4/2002
WO WO 96/09430 3/1996
WO WO 99/55952 A1 11/1999
WO WO 99/55953 A1 11/1999
WO WO 00/01421 A1 1/2000
WO WO 00/01422 A1 1/2000
WO WO 00/01423 A1 1/2000
WO WO 00/11133 3/2000
WO WO 00/24851 A2 5/2000

| | | | |
|---|---|---|---|
| WO | WO 00/24856 | A1 | 5/2000 |
| WO | WO 00/24858 | A1 | 5/2000 |
| WO | WO 00/38512 | A1 | 7/2000 |
| WO | WO 00/55292 | | 9/2000 |
| WO | WO 00 58428 | | 10/2000 |
| WO | WO 01/07710 | A1 | 2/2001 |
| WO | WO 01/18145 | A2 | 3/2001 |
| WO | WO 01/66264 | A1 | 9/2001 |
| WO | WO 01/89708 | A2 | 11/2001 |
| WO | WO 02/08510 | A1 | 1/2002 |
| WO | WO 02/12423 | A2 | 2/2002 |
| WO | WO 02/33161 | A1 | 4/2002 |
| WO | WO 02/40623 | A2 | 5/2002 |
| WO | WO 03/004170 | A1 | 1/2003 |
| WO | WO 03/008528 | A1 | 1/2003 |
| WO | WO 03/087286 | A1 | 10/2003 |
| WO | WO 03/087461 | A1 | 10/2003 |
| WO | WO 03/102289 | A1 | 12/2003 |
| WO | WO 2004/099489 | A2 | 11/2004 |
| WO | WO 2006/006016 | A1 | 1/2006 |

OTHER PUBLICATIONS

StainsFile—"Classification of Dyes"; "Basic Dyes"; "Direct Dyes"; "Acid Dyes"; Comparison of Dye Structure; "Structure and Colour in Dyes"; (16 pages). Internet Website http://members.pgonline.com/~bryand/StainsFile/dyes/class/dyeclass.htm, Nov. 2002.

Innovative Packaging Network—"Clean-Clic®" (1 page). Internet Website www.ipneurope.com/Componentright1.html.

Medlin, Jennifer—"Microban, Germ Warfare", Environmental Health Perspectives v.105, n.3, Mar. 1997 (5 pages). Internet Website www.mindfully.org/Plastic/Microban-Germ-Warfare.htm.

Exair-Mail Newsletter—Winter 2002-03 (2 pages). Exair Corporation, 1250 Century Circle North, Cincinnati, Ohio, 45246-3309.

Fyffe, Matt—Technical Report—"Recent Developments in Long-Range Static Elimination", Jun. 2003 (3 pages). Meech Static Eliminators, USA, Richfield, Ohio, Internet Website www.meech.com.

Quantum Research Group "Capacitance Explained" printed Nov. 18, 2004 (3 pages). Internet Website www.gprox.com/background/capacitance.php.

International Critical Tables of Numerical Data, Physics, Chemistry and Technology, National Research Council of the United States of America, Edward W. Washbum, editor in chief, first electronic edition, published by Knovel, Norwich, New York, 2003, pp. 148-162.

Handbook of Chemistry and Physics, 3rd electronic edition, following the 81st printed edition, David R. Lide, editor-in-chief, published by CRC Press, Inc. 2000, Boca Raton, Florida, pp. 5-102 to 5-103, 5-4 to 5-88.

Perry's Chemical Engineer's Handbook, seventh edition, following the 81st printed edition, published by McGraw-Hill, ISBN 0-07-049841-5, 1997, pp. 2-187 to 2-195.

U.S. Appl. No. 11/592,359, filed Nov. 3, 2006, Barron, et al.

U.S. Appl. No. 10/418,595, filed Apr. 17, 2003, Gerlach, et al.

U.S. Appl. No. 10/697,735, filed Oct. 29, 2003, Barron, et al.

U.S. Appl. No. 10/697,685, filed Oct. 29, 2003, Heilman, et al.

U.S. Appl. No. 10/697,734, filed Oct. 29, 2003, Pancheri, et al.

U.S. Appl. No. 10/697,736, filed Oct. 29, 2003, Pancheri, et al.

U.S. Appl. No. 10/762,152, filed Jan. 21, 2004, DuVal, et al.

U.S. Appl. No. 10/839,549, filed May 5, 2004, DuVal, et al.

U.S. Appl. No. 10/842,926, filed May 11, 2004, Zhang, et al.

U.S. Appl. No. 10/927,184, filed Aug. 26, 2004, Ward, et al.

U.S. Appl. No. 10/927,212, filed Aug. 26, 2004, Ofosu-Asante, et al.

U.S. Appl. No. 10/926,925, filed Aug. 26, 2004, DuVal, et al.

U.S. Appl. No. 10/927,210, filed Aug. 26, 2004, Lucas, et al.

U.S. Appl. No. 10/927,211, filed Aug. 26, 2004, Huston, et al.

U.S. Appl. No. 11/344,314, filed Jan. 31, 2006, Zhang, et al.

U.S. Appl. No. 11/171,102, filed Jun. 30, 2005, France, et al.

U.S. Appl. No. 11/171,100, filed Jun. 30, 2005, France, et al.

International Search Report, dated Sep. 29, 2005, 5 pages.

* cited by examiner

UNIFORM DELIVERY OF COMPOSITIONS

CROSS REFERENCE TO RELATED APPLICATIONS

This application claims the benefit of U.S. Provisional Application Ser. No. 60/568,771, filed on May 6, 2004 and is a continuation-in-part of U.S. application Ser. No. 10/842,926, filed on May 11, 2004; now U.S. Pat. No. 7,047,663 which is a continuation-in-part of U.S. application Ser. No. 10/839,549, filed on May 5, 2004; which is a continuation-in-part of U.S. application Ser. No. 10/762,152, filed on Jan. 21, 2004; now U.S. Pat. No. 7,503,127 which is a continuation-in-part of U.S. application Ser. No. 10/697,736, filed on Oct. 29, 2003; now abandoned U.S. application Ser. No. 10/697,734, filed on Oct. 29, 2003; now abandoned U.S. application Ser. No. 10/697,685, filed on Oct. 29, 2003; now U.S. Pat. No. 7,043,855 and U.S. application Ser. No. 10/697,735, filed Oct. 29, 2003; now U.S. Pat. No. 7,146,749 each of which is a continuation-in-part of U.S. application Ser. No. 10/418,595, filed on Apr. 17, 2003; now U.S. Pat. No. 7,059,065 which claims the benefit of U.S. Provisional Application Ser. No. 60/374,601, filed Apr. 22, 2002; and U.S. Provisional Application Ser. No. 60/426,438, filed Nov. 14, 2002.

FIELD OF THE INVENTION

The present invention relates to the uniform delivery of treatment materials in fabric article drying appliances such as tumble dryers.

BACKGROUND OF THE INVENTION

Traditionally when applying treatment materials to fabrics in a fabric article drying appliance such as a tumble dryer, it has been difficult to achieve a uniform distribution of the treatment material onto the fabric. If the distribution of the treatment material is not uniform, this results in areas of the fabric being left untreated. This uneven distribution further results in undesirable fabric attributes which can interfere with such things as the look, touch, smell, and longevity of the fabric. Additionally, in many instances, it has also been observed that rather than being desirably deposited onto the fabric, the treatment material ends up elsewhere such as being lost through the fabric article drying appliance vent. Hence, not only is uniform distribution of the treatment material on the fabric important, but also providing efficient delivery of the treatment material to the fabric such that the treatment material ends up on the fabric and not elsewhere.

Accordingly, there is a need to provide a convenient and effective way of uniformly and efficiently delivering treatment materials to fabrics in a fabric article drying appliance. The present invention addresses this need.

SUMMARY OF THE INVENTION

In one aspect, the present invention relates to a system for spraying fabric in a fabric article drying appliance. The system comprises:

a) a tumble dryer; and b) a spray for spraying a treatment composition onto fabric in the tumble dryer wherein the spray has:

i) a mean droplet size of the treatment composition of about 100 to about 1000 microns;

ii) a spray cone angle in the tumble dryer of about 35° to about 150°;

iii) a flowrate at the point the spray enters the tumble dryer of about 0.5 ml/min to about 100 ml/min; and iv) a linear velocity at the point the spray enters the tumble dryer of about 0.5 m/second to about 20 m/second.

In another aspect, the present invention may comprise a device for depositing benefit composition in a fabric article drying appliance. The device comprises a pump wherein the pump comprises a conduit having an inlet and a discharge and a nozzle having one or more orifices connected to the discharge of the conduit. The inlet of the conduit is in communication with a source of a benefit composition so as to dispense the benefit composition through the conduit to the nozzle whereby the benefit composition has a mean droplet size of from about 100 microns to about 1000 microns and wherein the cone angle formed by the benefit composition that is discharged from the nozzle is between about 35° and about 150°.

In a further aspect, the present invention relates to a device which provides uniform distribution of a treatment composition on fabric in a fabric article drying appliance. The device comprises a fabric article treating device wherein the fabric article treating device is associated with the drum of a tumble dryer in a manner such that a benefit composition is dispensed from the fabric article treating device in the form of a spray into the drum wherein the spray contacts the fabric in the drum so as to provide a uniformity of about 75% or more distribution of the benefit composition on fabric present in the drum.

In yet another aspect, the present invention relates to a method for depositing benefit composition in the drum of a tumble dryer. The method comprises providing a pump comprising a conduit wherein the conduit includes an inlet and discharge and a nozzle connected to the discharge of the conduit. The inlet of the conduit is placed in communication with the source of benefit composition wherein the inlet of the conduit is in communication with the source of benefit composition. The benefit composition is dispensed through the conduit from the source of benefit composition to the nozzle and into the drum of a tumble dryer whereby the benefit composition has a mean droplet size of from about 100 microns to about 1000 microns, a linear velocity through the nozzle of between about 0.5 m/second to about 2 m/second. The nozzle may be positioned in the dryer drum in quadrant one, quadrant two, quadrant three, quadrant four, or a combination thereof. The nozzle has a tilt angle wherein the tilt angle in quadrant one ranges from about 80° to the left to about 45° to the right and from about 45° up to about 35° down; the tilt angle in quadrant two ranges from about 80° to the right to about 45° to the left and from about 45° up to about 15° down; the tilt angle in quadrant three ranges from about 80° to the right to abut 45° to the left and about 45° up to about 15° down; the tilt angle in quadrant four ranges from about 80° to the left to about 15° to the right and about 45° up to about 15° down; and combinations thereof.

In a further aspect, the present invention relates to a method for providing efficient deposition of a benefit agent used to treat fabric. The method comprises providing a fabric article treating device and a benefit composition. The benefit composition is associated with the fabric article treating device such that the benefit composition is discharged into the drum of a tumble dryer either before the tumble dryer is rotated, during rotation of the tumble dryer, or after rotation of the tumble dryer, or a combination thereof. The cone angle formed by the benefit composition that is discharged into the tumble dryer is between about 35° to about 150°.

DETAILED DESCRIPTION OF THE INVENTION

Figure 1:
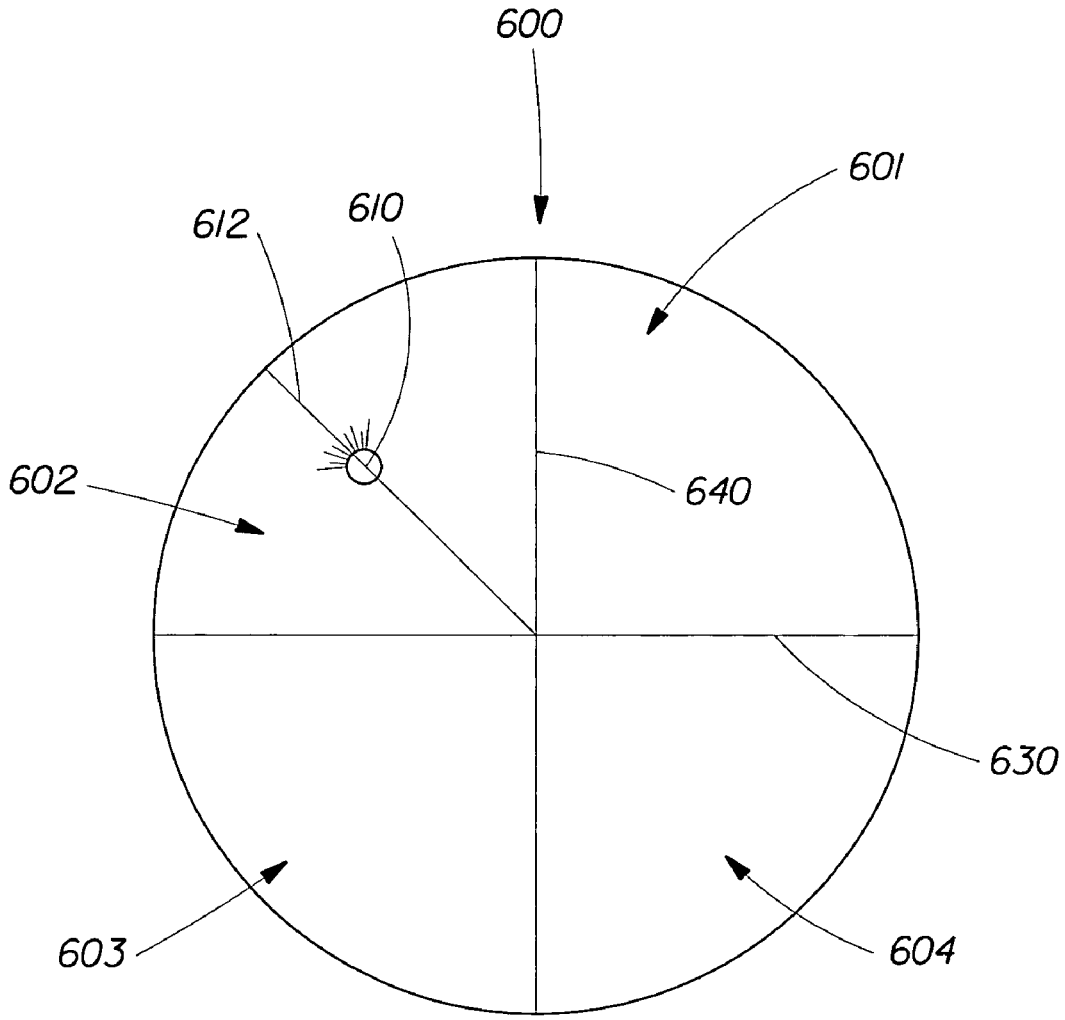
FIG. 1 is a front view of a dryer drum.

The present invention relates to the uniform distribution of treatment material onto fabrics in fabric article drying appliances such as tumble dryers. In another aspect, the invention relates to efficiently depositing the treatment materials on the fabric so that the materials are deposited on the fabric and not elsewhere.

DEFINITIONS

As used herein, "fabric article" means an article that comprises a fabric. Such articles include, but are not limited to, clothing, shoes, curtains, towels, linens, upholstery coverings and cleaning implements.

As used herein, "during a dryer cycle" means while the dryer is operating.

As used herein, "treatment material" means a material or combination of materials that can deliver benefits to a fabric article. Examples of such benefits include but are not limited to; softening, crispness, water and/or stain repellency, refreshing, antistatic, anti-shrinkage, anti-microbial, durable press, wrinkle resistance, odor resistance, abrasion resistance, anti-felting, anti-pilling, dimensional stability, appearance enhancement such as color and whiteness enhancement, anti-soil redeposition, fragrance, enhanced absorbency, and mixtures thereof.

As used herein, "fabric treatment composition" means a composition that comprises one or more treatment materials. Suitable forms of fabric treatment compositions include, but are not limited to, fluidic substances, such as liquids or gases, and solid compounds, such particles or powders.

As used herein, the terms "treatment material", "treatment composition", "fabric treatment composition" and "benefit composition" are used interchangeably.

As used herein, the articles "a", "an", and "the" when used in a claim, are understood to mean one or more of the material that is claimed or described.

Unless otherwise noted, all component or composition levels are in reference to the active level of that component or composition, and are exclusive of impurities, for example, residual solvents or by-products, which may be present in commercially available sources.

Unless otherwise indicated, all percentages and ratios are calculated based on weight of the total composition.

Unless otherwise indicated, all measurements herein were performed at a standard atmospheric pressure of about 1 bar.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Delivery System

In one aspect of the present invention, the delivery system is comprised of a spray for delivering treatment materials to fabrics in a fabric article drying appliance such as a tumble dryer. The dryer drum is typically rotating during delivery of the treatment materials but may also be stationary during delivery. The spray comprises a treatment composition. The treatment composition comprising the spray of the present invention has a mean droplet size of about 100 microns to about 1400 microns, about 200 microns to about 1300 microns, about 300 microns to about 1200 microns, or about 500 microns to about 100 microns. A suitable instrument for measuring droplet size is the Malvern particle sizer manufactured by Malvern Instruments Ltd. of Framingham, Mass.

The viscosity of the treatment composition comprising the spray, as measured at approximately 24° C. using a Model DV-II Brookfield Viscometer with a LV I spindle, is about 200 cps or less, about 100 cps or less, or about 50 cps or less. The Brookfield Model DV-II viscometer is available from Brookfield of Middleboro, Mass. The static surface tension of the treatment composition comprising the spray as measured between approximately 20° C.-25° C. is about 3 to about 100 dynes/cm, about 4 to about 70 dynes/cm, or about 5 to about 40 dynes/cm. A suitable instrument for measuring static surface tension is a Kruss Tensiometer, Model K12 manufactured by Kruss of Matthews, N.C.

The treatment composition may be sprayed through a nozzle and into the drum of a fabric article drying appliance such as the drum of a tumble dryer. The nozzle typically will have a diameter of about 200 to about 600 microns or about 250 to about 400 microns. A non-limiting example of a nozzle suitable for this purpose is a pressure swirl atomizing nozzle. Non-limiting examples of suitable nozzles include the Cosmos 13 NBU nozzle manufactured by Precision Valve Corporation of Marietta, Ga., the WX12 and WD32 nozzles manufactured by Saint-Gobain Calmar USA, Inc. of City of Industry, Calif., and Seaquist Model No. DU-3813 manufactured by Seaquist Dispensing of Cary, Ill. The nozzle may be in association with a spraying device. The nozzle may be permanently attached or releasably attached to a spraying device. One non-limiting example of a releasably attached nozzle is a nozzle which is threaded such that it can easily be removed from or placed in a spraying device. The nozzle may be disposable. The spraying device may be free standing or it may be associated with the drying appliance as discussed in further detail below.

It is desirable that the fabrics in the fabric article drying appliance not come into direct contact with the nozzle while the nozzle is operating as this may inhibit flow from the nozzle. Hence, it may be desirable for the nozzle to include a deflector which deflects the fabric away from the nozzle. The deflector may surround all or a portion of the nozzle (for example the top portion of the nozzle). The degree of extension of the deflector into the fabric article drying appliance is selected so as to insure that the deflector does not intercept the cone angle of the spray under normal use conditions. The deflector may be made from any suitable material, non-limiting examples of which include plastic, metal, Plexiglas, and the like. The deflector may be of any shape provided that the shape selected does not negatively impact fabric integrity during tumble drying process (i.e.; no sharp edges/corners or rough surfaces).

The placement of the nozzle and angle of the nozzle may be varied so as to optimize spray contact with the fabric in the tumble dryer. In order to facilitate the determination of where the nozzle should be positioned in relation to optimizing spray contact with the fabric, the dryer drum may be divided into four equal quadrants as shown in FIG. 1. The four quadrants (quadrant one 601, quadrant two 602, quadrant three 603, and quadrant four 604) are determined by the intersection of the x-axis 630 and y-axis 640 of the dryer drum 600. The position of the nozzle 610 may then be varied in relation to these quadrants. One non-limiting example of placement of the nozzle 610 within the quadrant may be along the quadrant bisection line 612 as shown for the second quadrant 602 in FIG. 1.

The nozzle 610 may also be angled in either the left to right direction and/or the up to down direction. This angling of the nozzle is referred to herein as "tilt angle". The tilt angle may vary from quadrant to quadrant. For instance, as viewed looking straight into the dryer drum from the door side of the dryer, in the first quadrant 601 the tilt angle may be from about 80° to the left to about 45° to the right and/or from about 45° up to about 35° down. In the second quadrant 602 the tilt angle may vary from about 80° to the right to about 45° to the left and/or from about 45° up to about 35° down. In the third quadrant 603 the tilt angle may vary from about 80° to the right to about 45° to the left and/or about 45° up and about 15° down. In the fourth quadrant 604 the tilt angle may vary from about 80° to the left to about 15° to the right and/or about 45° up and about 15° down.

The tilt angle is typically selected such that the nozzle is not directly aimed at the dryer vent/lint screen or at the top of the drum. Furthermore, it is generally desirable that the nozzle be angled such that the spray from the nozzle is delivered through the void space/tunnel created by the tumbling of the fabrics around the perimeter of the dryer drum so as to contact the fabrics at the bottom of the rotating circle of fabrics. Also it may be desirable that the nozzle be angled such that the spray intercepts the fabrics being tumbled in the dryer as the fabrics drop from their highest vertical point to their lowest vertical point during dryer drum rotation.

It may be desirable in some instances to utilize more than one nozzle. Each nozzle could be designed to spray concurrently or at different times, flow rate, velocity, etc. than the other nozzle(s).

The flowrate of the spray in the drum of the fabric article drying appliance such as a tumble dryer is about 0.5 to about 100 ml/minute, about 1 to about 75 ml/minute, about 2 to about 50 ml/minute, or about 15 to about 25 ml/minute. One suitable method for determining flow rate is found in ASME/ANSI MFC-9M-1988, entitled "Measurement of Liquid Flow in Closed Conduits by Weighing Method".

The linear velocity of the spray in the drum of the tumble dryer is about 0.05 to about 2 m/second or about 0.1 to about 1 m/second. The length of the spray in the drum of the tumble dryer is from about 20% to about 95% of the length of the drum as measured along the rotational axis of the drum. One suitable method for determining linear velocity is by utilizing Laser Doppler Anemometry such as described in "*Laser Doppler and Phase Doppler Measurement Techniques*" part of the "*Experimental Fluid Mechanics*" series, written by Albrecht, H. E., Damaschke, N., Borys, M., and Tropea, C., 2003, XIV, 738, page 382.

The cone angle of the spray refers to the angle the spray forms as it is sprayed into the drum of the tumble dryer. A method for determining cone angle is described below. The cone angle of the spray is about 35° to about 150° or about 40° to about 110° or about 50° to about 90°.

Spraying Device

As previously indicated the present invention may include a spraying device for delivering the benefit composition into the tumble dryer. The spraying device may be a stand-alone device or it may be incorporated into the fabric article drying appliance. As used herein the term "spraying device" is used interchangeably with the term "fabric article treating apparatus". Non-limiting examples of suitable spraying devices which may be used with the present invention are disclosed in the following commonly assigned co-pending applications: U.S. patent application Publication No. 2004/0259750, published on Dec. 23, 2004 and entitled "Processes and Apparatuses for Applying a Benefit Composition to One or More Fabric Articles During a Fabric Enhancement Operation"; WO 2004/12007, published on Nov. 4, 2004 and entitled "Volatile Material Delivery Method"; U.S. patent application Publication No. 2004/0123490, published Jul. 1, 2004 and entitled "Fabric Article Treating Method and Device Comprising a Heating Means"; U.S. patent application Publication No. 2004/0123489, published on Jul. 1, 2004 and entitled "Thermal Protection of Fabric Article Treating Device"; U.S. patent application Publication No. 2004/0134090, published on Jul. 15, 2004 and entitled "Fabric Article Treating Device Comprising More Than One Housing"; U.S. application Publication No. 2004/0025368, published on Jul. 29, 2004 and entitled "Fabric Article Treating Apparatus with Safety Device and Controller"; and U.S. application Publication No. 2004/0025368, published on Feb. 12, 2004 and entitled "Fabric Article Treating Method and Apparatus".

In one aspect of the present invention, the spraying system is comprised of a pump, a nozzle, a source of benefit composition, and a conduit as described in further detail below. The conduit connects the source of the benefit composition to the pump whereby the benefit composition is discharged through the nozzle of the pump into a tumble dryer. Alternatively, the conduit connects the source of the benefit composition to the pump whereby the benefit composition is transported via conduit between the pump and nozzle and then discharged into a tumble dryer. It should be noted that the interior of the conduit may be of any shape, non-limiting examples of which include circular and/or oval shaped. It may also be desirable to include a check valve in the conduit before the nozzle. Non-limiting examples of minimum working pressures for the check valve are from about 0.1 psi to about 2 psi or from about 0.5 psi to about 1 psi.

The pump may be manually operated, and/or the pump may be automated. The pump may be mechanically driven, electrically driven, or a combination thereof.

The spraying system may comprise: a housing or enclosure that contains a source of the fabric treatment composition, such as a reservoir or is in communication with an external source of the fabric treatment composition; an output device, such as a nozzle; a controller, such as an electronic control device with a processing circuit and input and output circuits; one or more sensors, such as a temperature sensor, light sensor, motion sensor, or the like; one or more input devices, such as a start switch and/or a keypad; one or more indicating devices, such as color lights or LED's; and a charging system if the fabric treatment composition is to be electrostatically charged before (or while) being delivered.

Reference will now be made in detail to suitable embodiments of devices for delivering a fabric treatment composition in accordance with one of the aforementioned temperature or time profiles, an example of which is illustrated in the accompanying drawings, wherein like numerals indicate the same elements throughout the views.

FIGS. 2-5 illustrate one embodiment of an exemplary spray system which may be used in the present invention.

Figure 2:
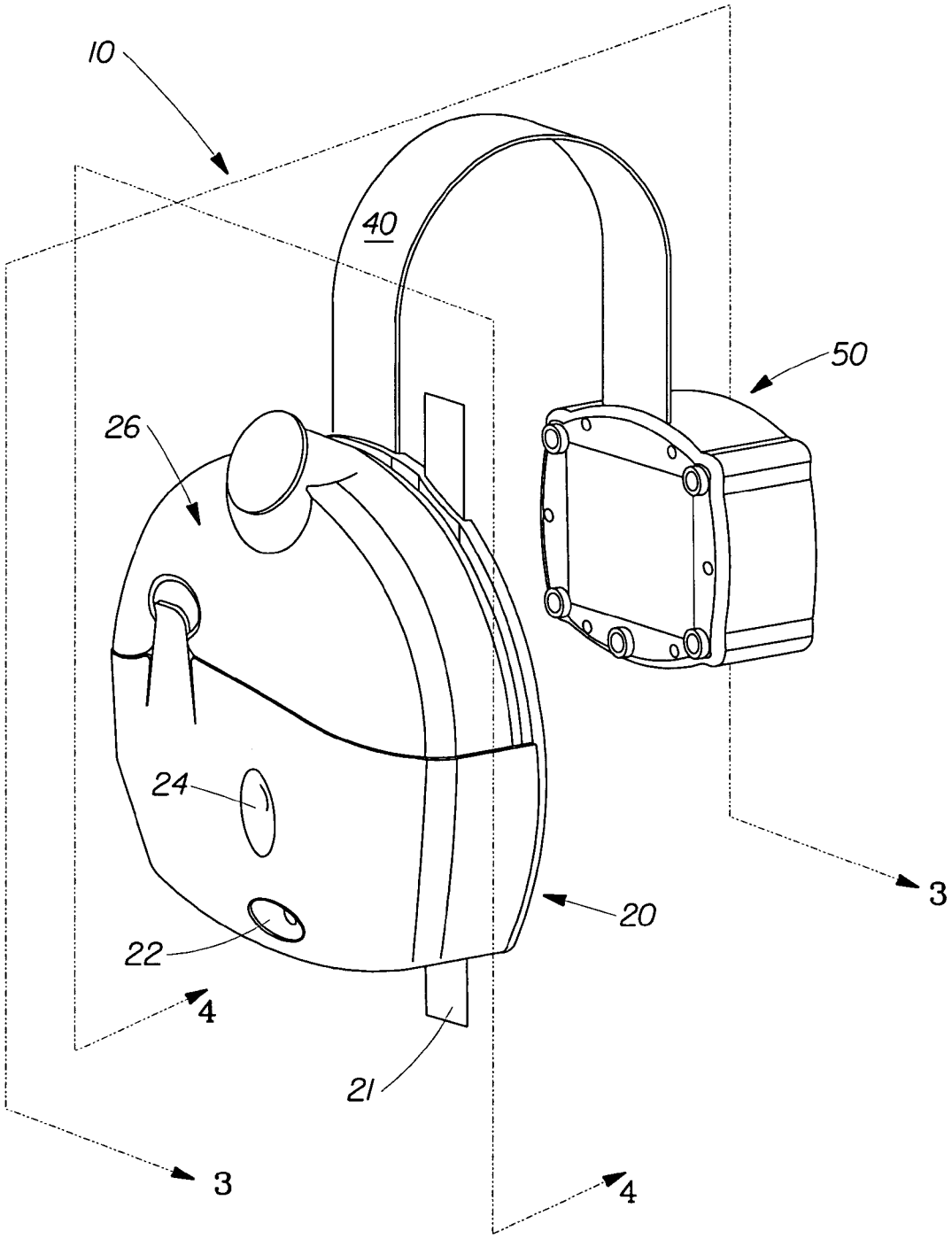
FIG. 2 is a perspective view of an embodiment of a stand-alone fabric article treating apparatus made according to the principles of the present invention.

Referring now to the embodiment of FIG. 2, a "stand-alone" controller and dispenser unit (i.e., as a self-contained device), generally designated by the reference numeral 10, is illustrated as having two major enclosures (or housings) 20 and 50. In this embodiment, the enclosure 20 acts as an "inner housing" which is located in the interior of a fabric article drying appliance (e.g., a clothes dryer), while the enclosure 50 acts as an "outer housing" that is located in the exterior of the fabric article drying appliance. The enclosure 50 may be mounted on the exterior surface of the fabric article drying appliance door, however, it may instead be mounted on any exterior surface, non-limiting examples of which include: the side walls, the top walls, the outer surface of a top-opening lid, and the like, including a wall or other household structure that is separate from the fabric article drying appliance. Furthermore, the enclosure 20 may be mounted on any interior surface of the fabric article drying appliance, examples of which include, but are not limited to: the interior surface of the door, the drum of the fabric article drying appliance, the back wall, the inner surface of a top-opening lid, and the like.

Figure 7:
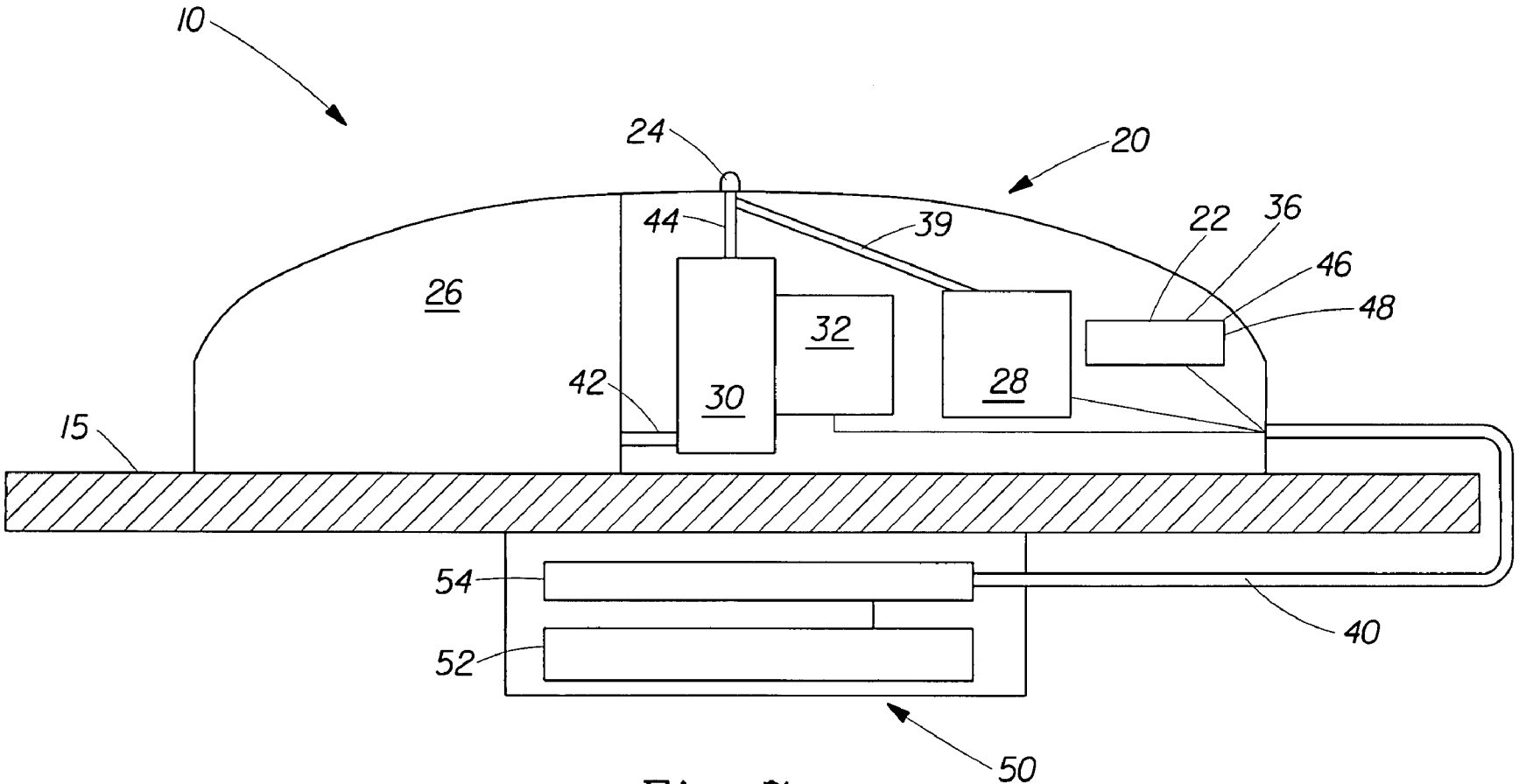
FIG. 7 is a diagrammatic view in partial cross-section of the fabric article treating apparatus of FIG. 2, as it is mounted to the door of a clothes dryer apparatus.

Enclosure 50 may be permanently mounted to the exterior surface, or preferably releasably attached to the exterior surface. Likewise, enclosure 20 may be permanently mounted to the interior surface, or releasably attached to the interior surface. One configuration for such an attachment is illustrated in FIG. 7, in which the door of the drying appliance is generally designated by the reference numeral 15.

When mounted on the interior surface of the door, for example, the enclosure 20 may be constructed so as to have the appearance of being "permanently" mounted, such that it seems to be "built into" the door of a dryer unit (or other type of fabric article drying appliance), without it actually being truly constructed as part of the fabric article drying appliance. On the other hand, enclosure 20 perhaps may be more loosely mounted near the door, or along side the interior surface of the door, much like one of the embodiments 10 as depicted in FIGS. 2-5 that "hangs" along a vertical door of the appliance. It will be understood that the term "door," as used herein, represents a movable closure structure that allows a person to access an interior volume of the dryer apparatus, and can be of virtually any physical form that will enable such access. The door "closure structure" could be a lid on the upper surface of the dryer apparatus, or a hatch of some sort, or the like.

It should be noted that the treating apparatus 10 may be grounded by way of being in contact with a grounded part of the fabric article drying appliance such as by a spring, patch, magnet, screw, or other attaching means, and/or by arc corona discharge, or by way of dissipating residual charge. One non-limiting way of dissipating the charge is by using an ionizing feature, for example a set of metallic wires extending away from the source. In many instances fabric article drying appliances such as clothes dryers have an enameled surface. One method of grounding would be to ground to the enameled surface of the fabric article drying appliance by utilizing a pin that penetrates the non-conductive enamel paint for grounding thereto. Another method of grounding to the non-conductive surface of a fabric article drying appliance comprises the usage of a thin metal plate that is positioned between the fabric article drying appliance and the fabric article treating device which serves to provide a capacitive discharge. Typical thickness of such a plate is from about 5 microns to about 5000 microns.

In FIG. 2, a discharge nozzle 24 and a "door sensor" 22 are visible on the inner housing 20, which also includes a benefit composition-holding reservoir 26 within an interior volume of the inner housing 20. The reservoir 26 may be used to hold a benefit composition. The discharge nozzle 24 can act as a fluid atomizing nozzle, using either a pressurized spray or, along with an optional high voltage power supply (not shown in FIG. 2) it can act as an electrostatic nozzle. The benefit composition can comprise a fluidic substance, such as a liquid or a gaseous compound, or it can comprise a solid compound in the form of particles, such as a powder, or solid particles in solution with a liquid. Reservoir 26 can be of essentially any size and shape, and could take the form, for example, of a pouch or a cartridge; or perhaps the reservoir could merely be a household water line for situations in which the benefit composition comprises potable water.

The inner housing 20 and outer housing 50 are typically in electrical communication. In the embodiment of FIG. 2, a flat cable 40 (also sometimes referred to as a "ribbon cable") is run between the two housings 20 and 50, and travels along the inner surface of the fabric article drying appliance door 15 (see FIG. 7, for example), over the top of the door 15, and down the exterior surface of the door 15.

Figure 3:
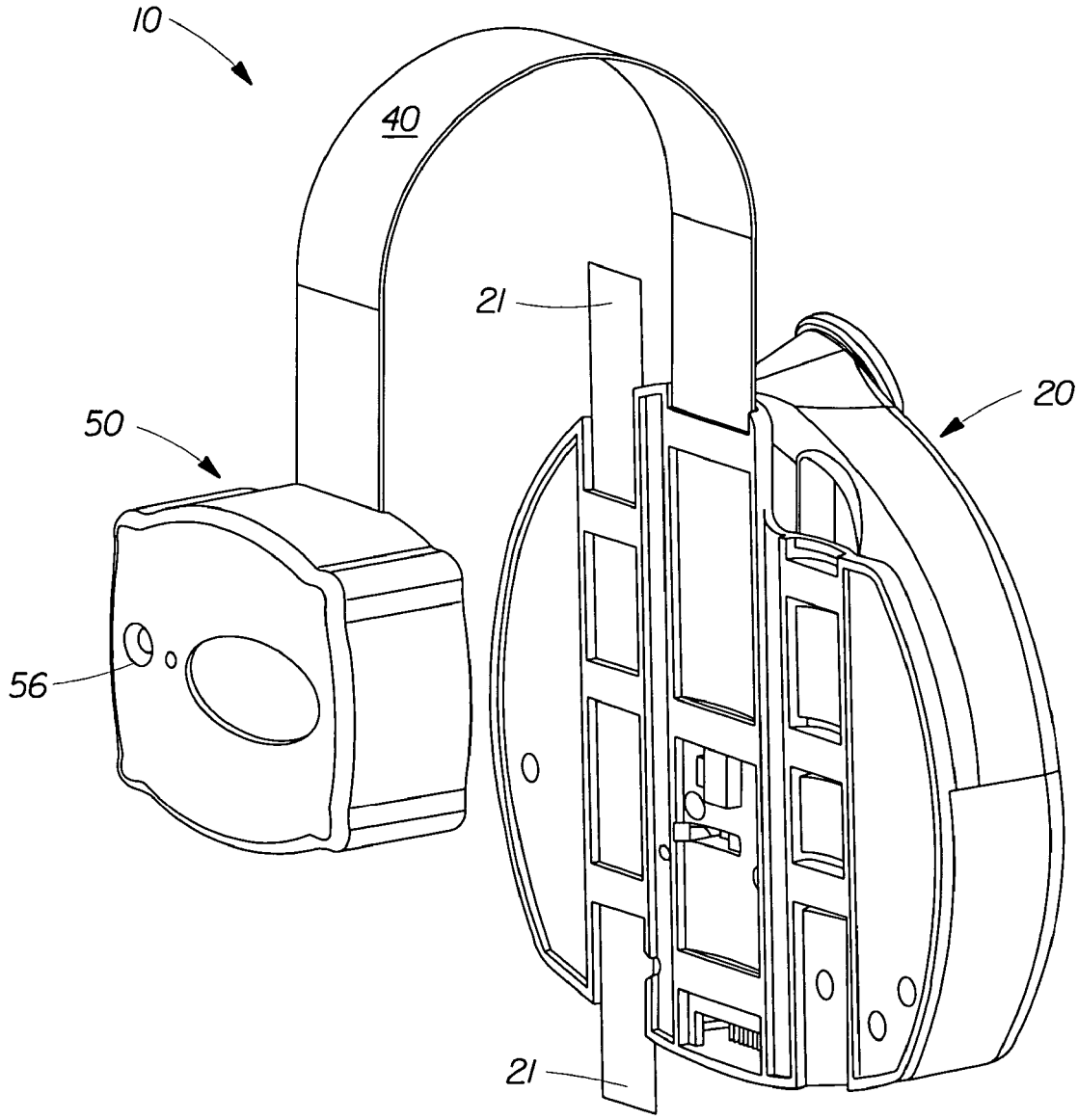
FIG. 3 is a perspective view from the opposite angle of the fabric article treating apparatus of FIG. 2.

FIG. 3 shows the same fabric article treating apparatus 10 from an opposite angle, in which the outer housing 50 is provided with an ON-OFF switch at 56. The flat cable 40 is again visible in FIG. 3, and along the surface of the inner housing 20 visible in FIG. 3, a door mounting strap 21 is visible. An end of the mounting strap is also visible in FIG. 2. Certainly other arrangements for attaching the inner housing 20 to a dryer door 15 (or other interior surface) are available without departing from the principles of the present invention, non-limiting examples of which include magnets, suction cups, and hooks.

Figure 4:
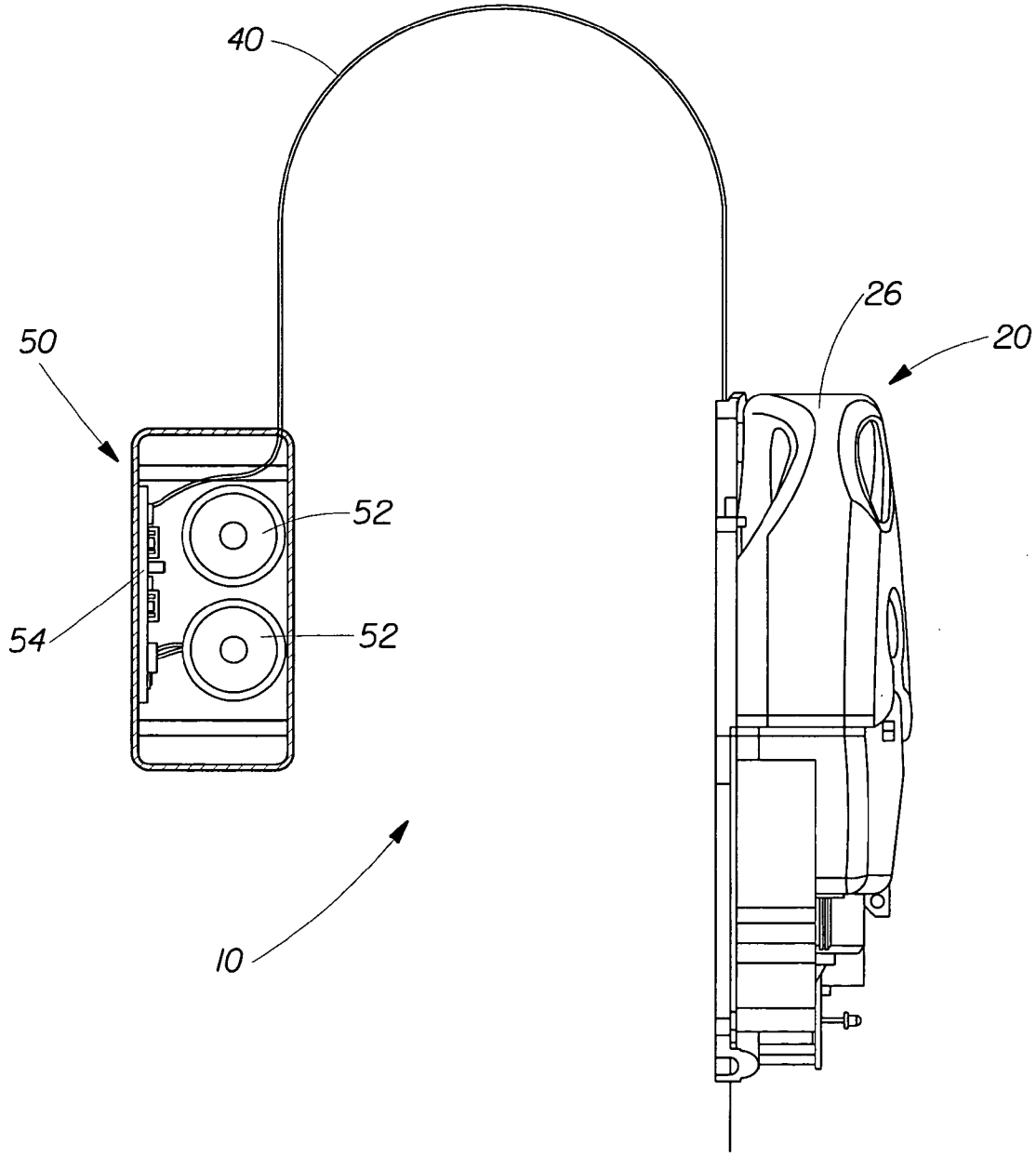
FIG. 4 is an elevational view from one end in partial cross-section of the fabric article treating apparatus of FIG. 2, illustrating the internal housing and external housing, as joined together by a flat cable.

Referring now to FIG. 4, the fabric article treating apparatus 10 is illustrated such that the reservoir 26 can be seen as an interior volume of the inner housing 20. In the outer housing 50, a set of batteries 52 can be seen, as well as a printed circuit board with electronic components at 54. It will be understood that any type of electrical power source could be used in the present invention, including standard household line voltage, batteries, or even solar power.

Figure 5:
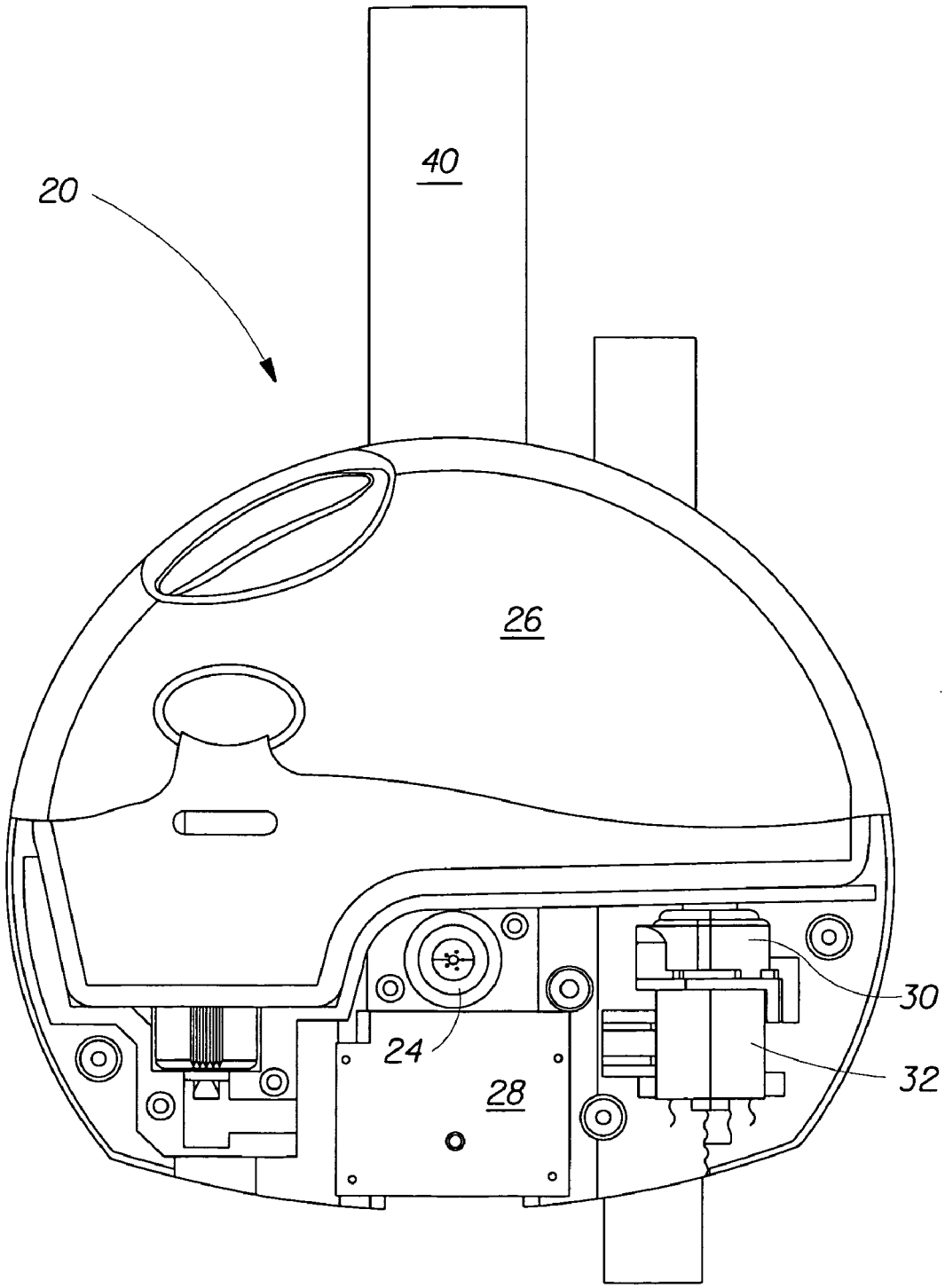
FIG. 5 is an elevational view from one side in partial cross-section of the internal housing portion of the fabric article treating apparatus of FIG. 2.
Figure 6:
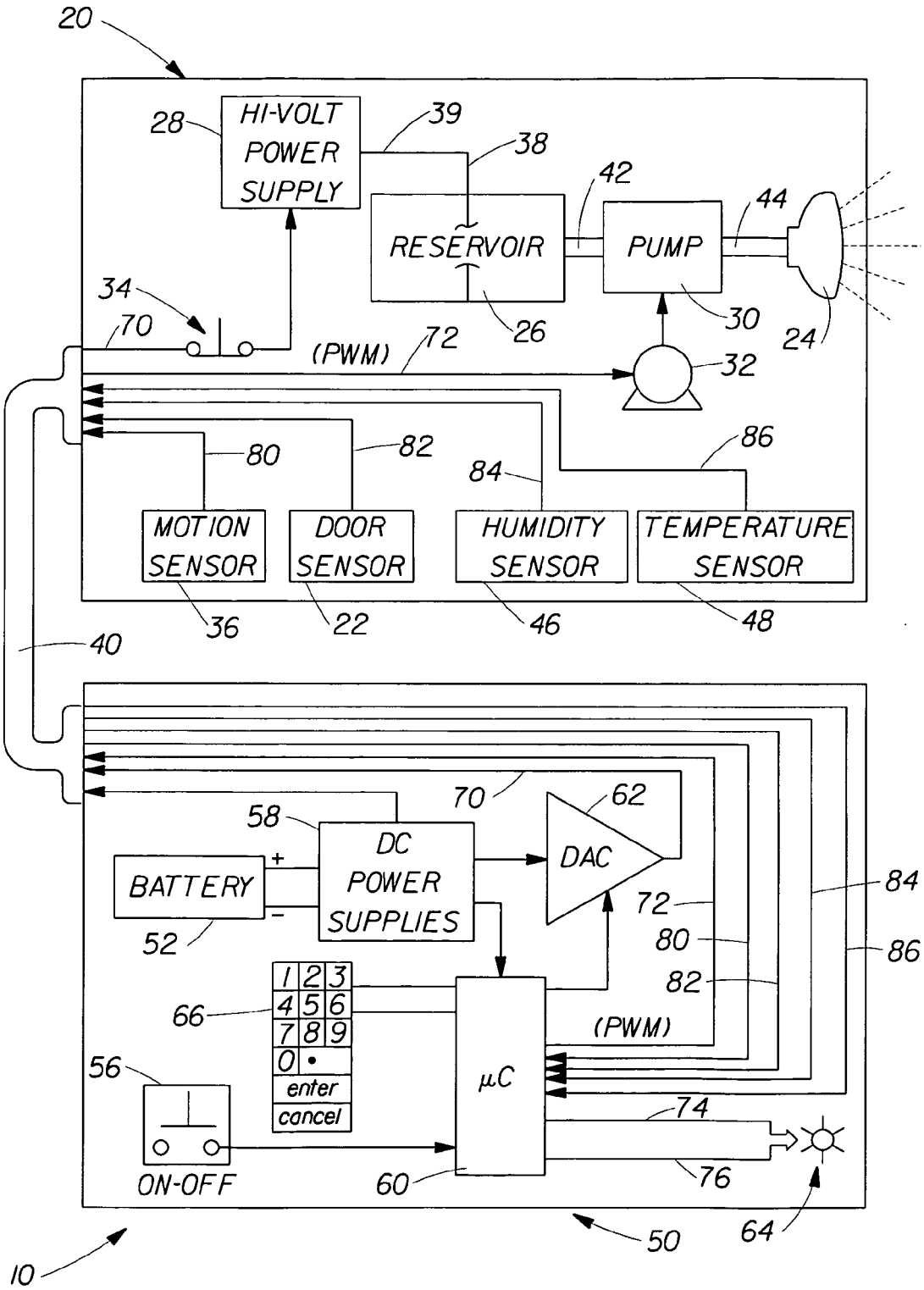
FIG. 6 is a block diagram of some of the electrical and mechanical components utilized in the fabric article treating apparatus of FIG. 2.

Referring now to FIG. 5, some of the other hardware devices are illustrated with respect to the inner housing 20. In the embodiment of FIG. 5, the discharge nozzle 24 acts as an electrostatic nozzle, and thereby is coupled with a high voltage power supply 28, by use of an electrical conductor not shown in this view. As shown in FIG. 6, a quick disconnect switch 34 is included for safety purposes, so that the high voltage power supply 28 can be quickly shut down if necessary. A pump 30 and a corresponding electric motor 32 are visible in FIG. 5. Some type of pumping apparatus is used regardless as to whether the discharge nozzle 24 is producing a pressurized spray only, or an electrostatic spray that utilizes a high voltage power supply 28.

FIG. 6 provides a block diagram of some of the electrical and mechanical components that may be included in a fabric article treating apparatus 10, suitable for use with the present invention. In this example embodiment, the high voltage power supply 28 is provided in the inner housing 20, which will be used to electrically charge the fluid that will be dispensed through the discharge nozzle 24, thus making this an electrostatic nozzle system. The inner housing 20 utilizes a general body or enclosure to contain the devices needed within the drying appliance, and it will be understood that such components will generally be subjected to relatively high temperatures during the treatment cycle of the drying appliance. Consequently, the more sensitive electronic components will generally (but not always) be mounted in a different location, such as in the outer housing 50.

The flat cable 40 will bring certain command signals and electrical power into the inner housing 20, and will also receive electrical signals from sensors mounted in the inner housing 20 and communicate those sensor signals back to the outer housing 50. A power supply control signal follows a wire 70 through the quick disconnect switch 34 to the high voltage power supply 28. This signal can comprise a constant DC voltage, a constant AC voltage, a variable DC voltage, a variable AC voltage, or some type of pulse voltage, depending on the type of control methodology selected by the designer of the fabric article treating apparatus 10.

In one embodiment, the signal at 70 is a variable DC voltage, and as this voltage increases, the output of the high voltage power supply 28 will also increase in voltage magnitude, along a conductor 39 (e.g., a wire) that is attached to an electrode 38 that carries the high voltage to the nozzle 24, or into the reservoir 26. The voltage impressed onto the electrode 38 will then be transferred into the benefit composition. A constant output voltage DC high voltage power supply could optionally be used instead of the variable output voltage power supply 28 of the exemplary embodiment.

Once the benefit composition is charged within the reservoir 26 it will travel through a tube or channel 42 to the inlet of the pump 30, after which the composition will be pressurized and travel through the outlet of the pump along another tube (or channel) 44 to the discharge nozzle 24. For use in the present invention, the actual details of the type of tubing used, the type of pump 30, and the type of electric motor 32 that drives the pump, can be readily configured for almost any type of pressure and flow requirements. The electrical voltage and current requirements of the electric motor 32 to provide the desired pressure and flow on the outlet of the pump 30 can also be readily configured for use in the present invention. Virtually any type of pump and electric motor combination can be utilized in some form or another to create a useful device that falls within the teachings of the present invention, or a stand-alone pump can be used (i.e., without an associated electric motor).

It should be noted that some types of pumps do not require separate input and output lines or tubes to be connected thereto, such as peristaltic pumps, in which the pump acts upon a continuous tube that extends through an inlet opening and continues through a discharge opening of the pump. This arrangement is particularly beneficial for use with electrostatically charged fluids or particles that are being pumped toward the discharge nozzle 24, because the tubing can electrically insulate the pump from the charged benefit composition. It should also be noted that an alternative pumping device could be used, if desired, such as a spring-actuated pumping mechanism. A non-limiting example of a suitable peristaltic pump is the Model 10/30 peristaltic pump, which may be obtained from Thomas Industries of Louisville, Ky.

If desired, the fabric article treating apparatus 10 can be enhanced by use of certain sensors, examples of which include but are not limited to a door (or lid) sensor 22, a motion sensor 36, a humidity sensor 46, and/or a temperature sensor 48.

FIG. 7 diagrammatically shows the general location of some of the components of one of the stand-alone embodiments of the fabric article treating apparatus 10 which may be used with the present invention. As discussed above, the electronics 54 and the batteries 52 are located within the outer housing 50, which is electrically connected to a flat cable 40 that carries power supply and input/output signals between the outer housing 50 and the inner housing 20.

Contained within the inner housing 20 are the reservoir 26, pump 30, electric motor 32, high voltage power supply 28, discharge nozzle 24, and various sensors that may or may not be included for a particular version of the treating apparatus 10. The electrical conductor 39 is depicted, which carries the high voltage to the nozzle 24, and this is one configuration that could be alternatively used instead of carrying the high voltage to the reservoir 26. The tubing 42 to the inlet of the pump is illustrated, as well as the tubing 44 from the outlet of the pump that provides the benefit composition to the nozzle 24. It should be noted that the high voltage power supply 28 is strictly optional within the teachings of the present invention; if spray droplets/particles emitted from the nozzle 24 are not to be electrostatically charged, then there is no need for a high voltage power supply within the inner housing 20.

Figure 8:
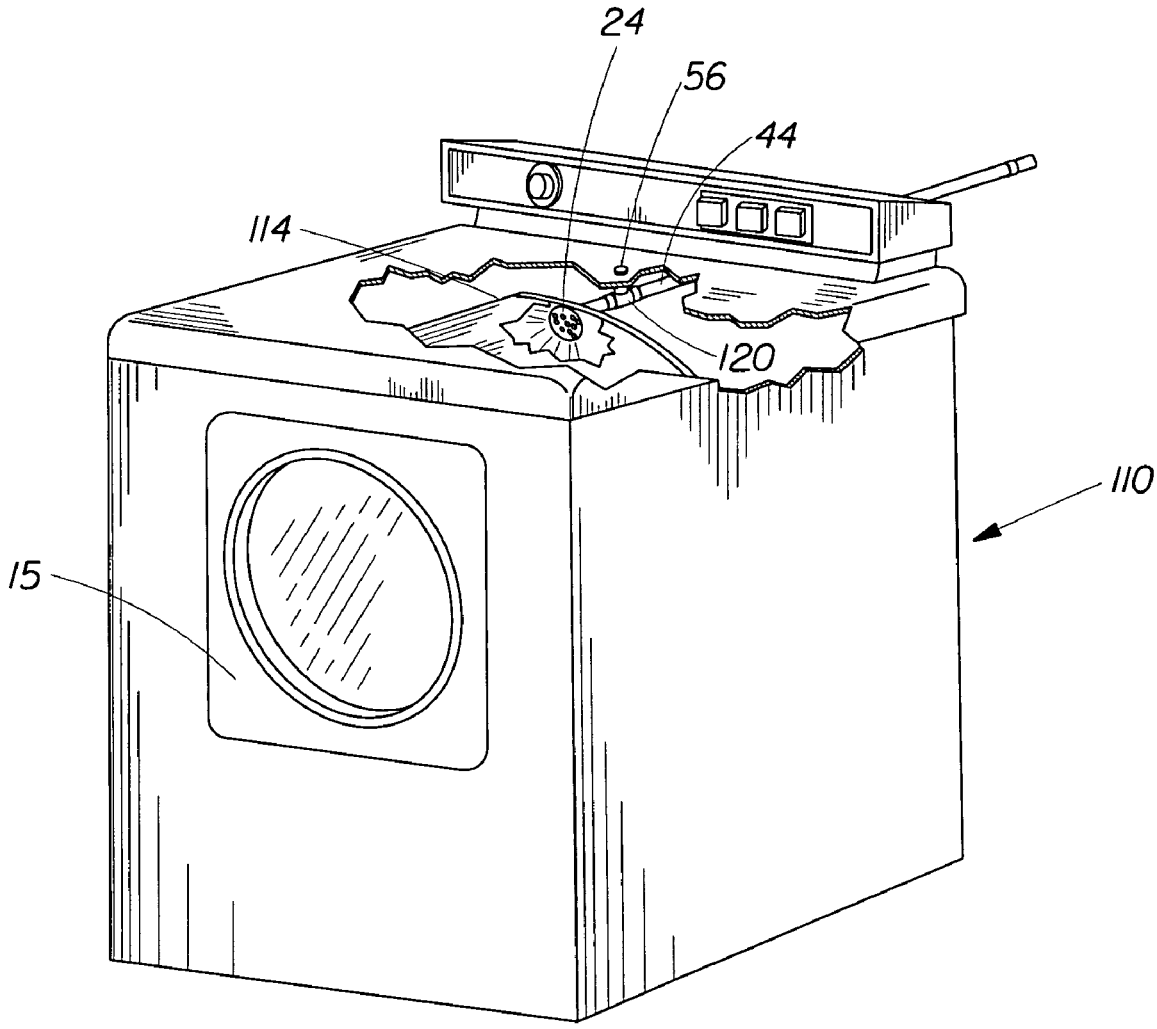
FIG. 8 is a perspective view of a fabric article drying appliance that has a nozzle which sprays a benefit composition into the drum portion of the dryer, as constructed according to the principles of the present invention.

FIG. 8 illustrates an alternative embodiment for use with the present invention, which depicts a fabric article drying appliance generally designated by the reference numeral 110. In this mode of the present invention, the controller depicted in the stand-alone embodiment of the earlier figures is now integrated into the electronic control system of the drying appliance 110. A door 15 is illustrated in FIG. 8, which is the normal point of access by a human user to the interior drum volume of the drying appliance 110. A nozzle 24 is used to direct a benefit composition into the drum area, in which the drum is generally designated by the reference numeral 114. A supply pipe 44 brings the benefit composition to the nozzle 24, through a control valve 120, that can have an ON/OFF push button 56, if desired.

Figure 9:
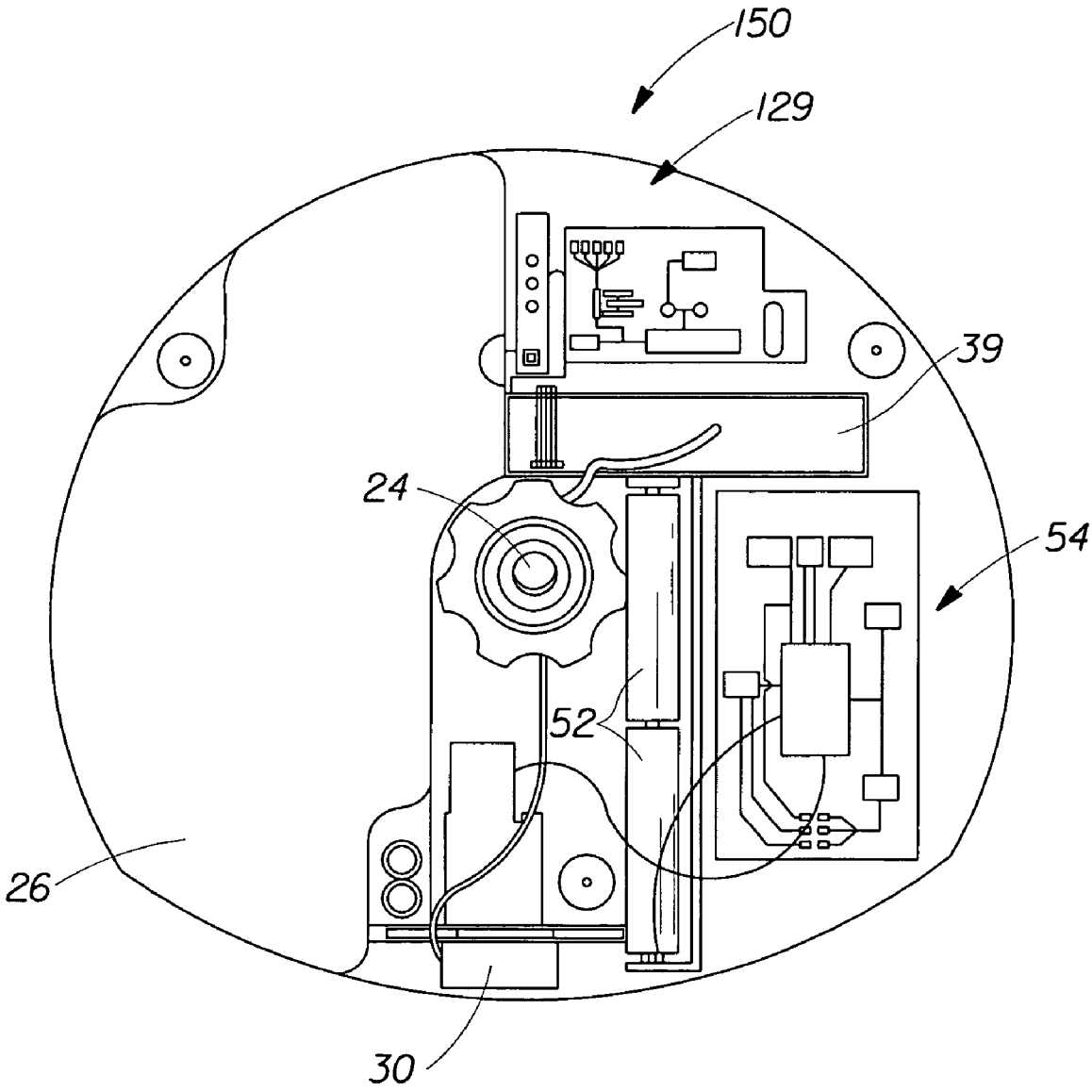
FIG. 9 is a diagrammatic view of some of the components utilized by an alternative embodiment stand-alone fabric article treating apparatus that is constructed according to the principles of the present invention, in which the entire treating apparatus is contained within a single housing or enclosure.

FIG. 9 illustrates an alternative stand-alone embodiment of the present invention, generally designated by the reference numeral 150. Components illustrated in FIG. 9 include a reservoir (or chamber) 26, an optional charging component 39 (such as an electrode or other type of electrical conductor that transports a high voltage to the reservoir or to the nozzle), a discharge nozzle 24, a pump unit 30, and a set of batteries 52. An electronic printed circuit board 54 is provided, which would typically include a microcontroller or other type of control circuit. One or more sensors may be included in such a device, as depicted at the reference numeral 129, and may include a pressure sensor, a door sensor 22, motion sensor 36, humidity sensor 46, and/or a temperature sensor 48. In this embodiment 150, all of the components are enclosed in a single housing, and the entire unit is positioned within a fabric article drying appliance, such as a conventional clothes dryer found in a consumer's home.

The "single-housing" stand-alone unit 150 of FIG. 9 can incorporate all of the electrical and electronic components that are described herein with respect to FIG. 6-7.

In FIGS. 10-14, where like reference numerals indicate like elements, a benefit composition dispensing apparatus 1100 constructed in accordance with a third embodiment of the present invention is illustrated. The apparatus 1100 comprises two enclosures or housings 1120 and 1150. Enclosure 1120 defines an "inner housing" located in an interior of a fabric enhancement apparatus such as a fabric article drying appliance, e.g., a clothes dryer (not shown in FIGS. 10-14), while the enclosure 1150 defines an "outer housing" located outside of the fabric article drying appliance. The fabric enhancement apparatus may also comprise a laundry apparatus or a laundry and drying apparatus. The enclosure 1150 may be mounted on an exterior surface of the fabric enhancement apparatus door (not shown), such as by pressure sensitive, thermally stable adhesive foam strips (not shown). Alternatively, the enclosure 1150 may be mounted on any other exterior surface of the fabric enhancement apparatus, non-limiting examples of which include: side walls, top walls, an outer surface of a top-opening lid, and the like. The enclosure 1150 may also be mounted on a wall or other household structure that is separate from the fabric enhancement apparatus. Furthermore, the enclosure 1120 may be mounted, such as by pressure sensitive, thermally stable adhesive foam strips (not shown), on any interior surface of the fabric enhancement apparatus, examples of which include, but are not limited to: the interior surface of the door, a drum of the apparatus, the back wall, the inner surface of a top-opening lid, and the like.

Figure 10:
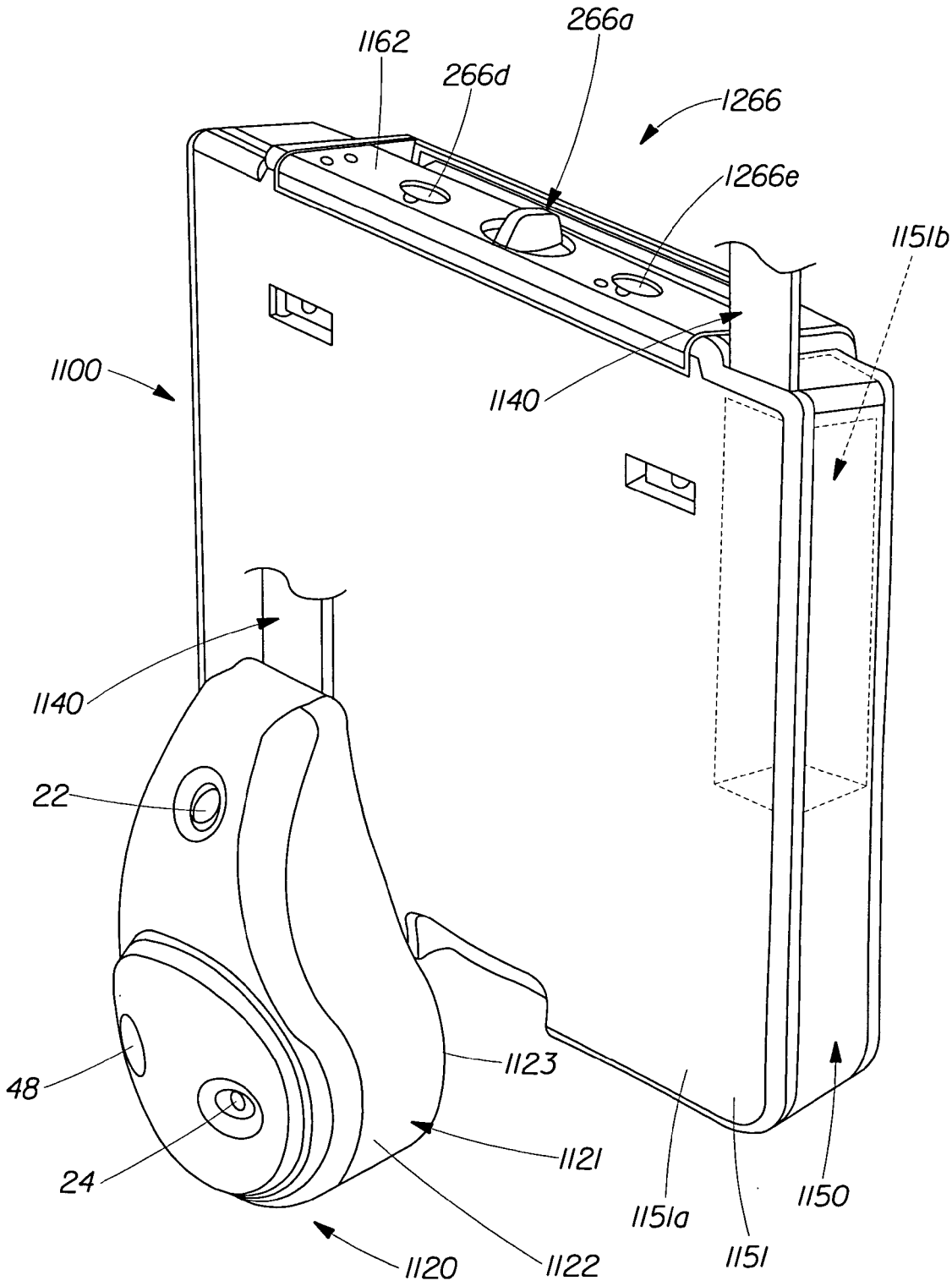
FIG. 10 is a perspective view of another embodiment of a stand-alone unit for dispensing a benefit composition constructed according to the principles of the present invention.
Figure 11:
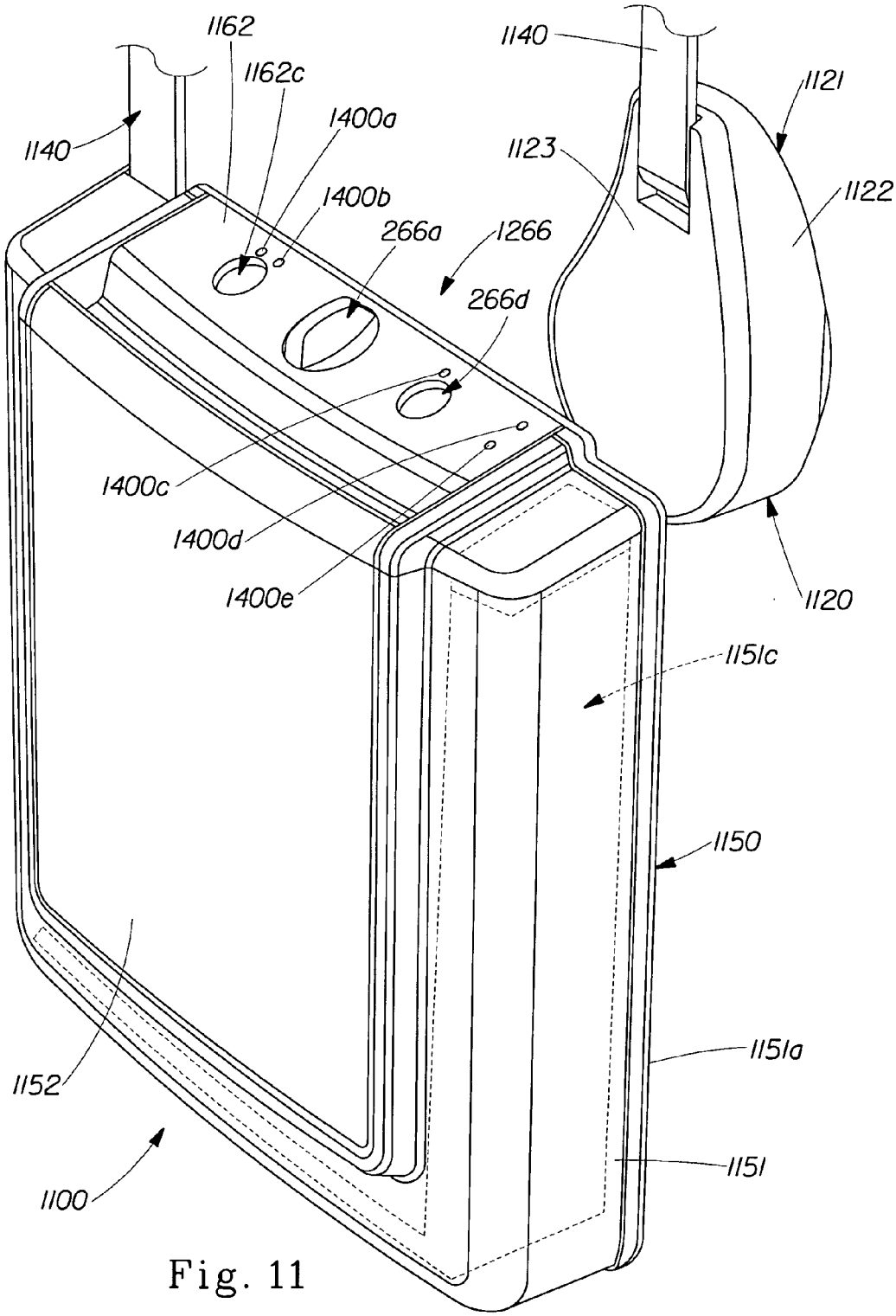
FIG. 11 is a perspective view from an opposite angle of the unit of FIG. 10.

As illustrated in FIGS. 10 and 11, the inner housing enclosure 1120 comprises a main body 1121 comprising an integral front/side main section 1122 and a back plate section 1123 secured to the main section 1122 via screws, adhesive, snap-fit elements or the like. The sections 1122 and 1123 are preferably molded from a polymeric material. Housed within the main body 1121 may be the following elements: a discharge nozzle 24; a door sensor 22 for sensing ambient light when the door of the fabric enhancement apparatus is open such that the sensor 22 is exposed to ambient light; a motion sensor 36 (contained within the main body 1121 and not visible from outside the main body 1121); a humidity sensor 46 (not shown in FIGS. 10 and 11); and a temperature sensor 48. In this embodiment, the nozzle 24 is not combined with a high voltage power supply. The nozzle 24 functions as a fluid atomizing nozzle so as to generate a pressurized spray.

Figure 12:
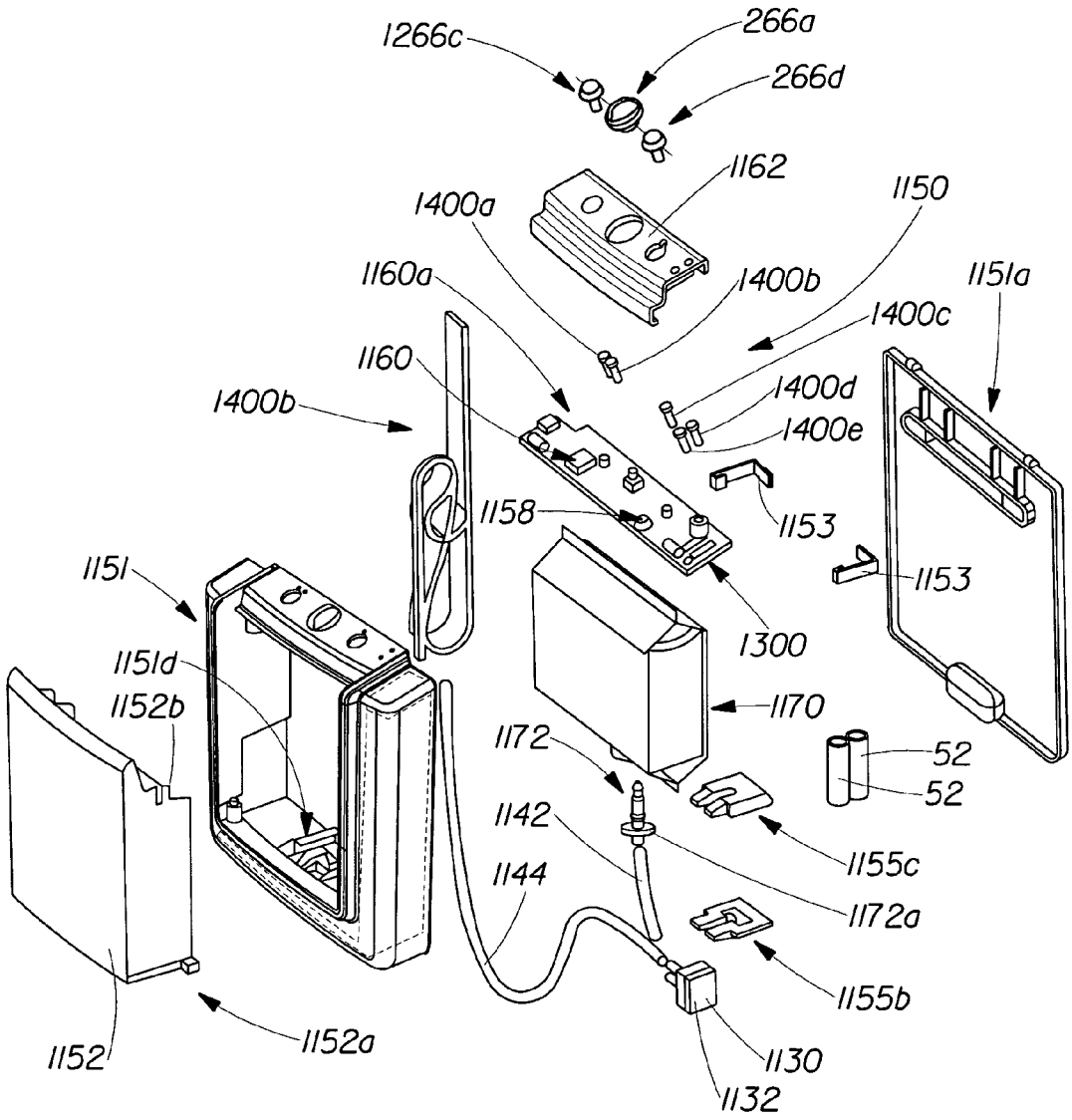
FIG. 12 is an exploded view of the unit illustrated in FIGS. 10 and 11.

Referring to FIGS. 10-12 and 15, the enclosure 1150 comprises a main body 1151 having a back wall 1151*a*, a first inner compartment 1151*b*, for storing varying lengths of unused cable 1140, to be described below, and a second compartment 1151*c*, for storing a fluid pump 1130, a motor 1132 for driving the pump 1130, batteries 52, a tube 1142 (to be discussed below) and a portion of a tube 1144 (to be discussed below). The enclosure 1150 further comprises a cassette door 1152 pivotably coupled to the main body 1151 such as by pins 1152*a* (only one of which is illustrated in FIG. 12), a printed circuit board 1160*a* and a face plate 1162. The printed circuit board 1160*a* is housed between the main body 1151 and the face plate 1162. The face plate 1162 is coupled to the main body 1151 via screws, adhesive, snap-fit elements, or like coupling elements. The pivotable door 1152 comprises a pocket 1152*b* for receiving a fluid reservoir defined by a removable container 1170 filled with a benefit composition, which composition may comprise any one of the benefit compositions discussed in this document or the documents noted herein. The container 1170 may be formed from a polymeric material, paper, foil, a combination of these materials or a like material. The door 1152 is releasably held in a closed position within the main body 1151 via first and second flex arms 1153, which are coupled to the main body 1151.

Extending through corresponding openings in the face plate 1162 are an ON-OFF switch 1266*c*, a "refluff" key or switch 266*d*, and a dial 266*a*, which may comprise a potentiometer, which a user rotates to dial in a desired one of a strong, regular or light setting corresponding to a strong, regular or light benefit level to be provided by a benefit composition to at least one fabric article during a fabric enhancement operation.

The cable 1140 is coupled to and extends between the enclosures 1120 and 1150. The cable 1140 may run along the inner surface of the fabric enhancement apparatus door, over the top of the door, and down the exterior surface of the door. Any unused length of the cable 1140 can be manually inserted into the first compartment 1151*b* for storage.

Figure 14:
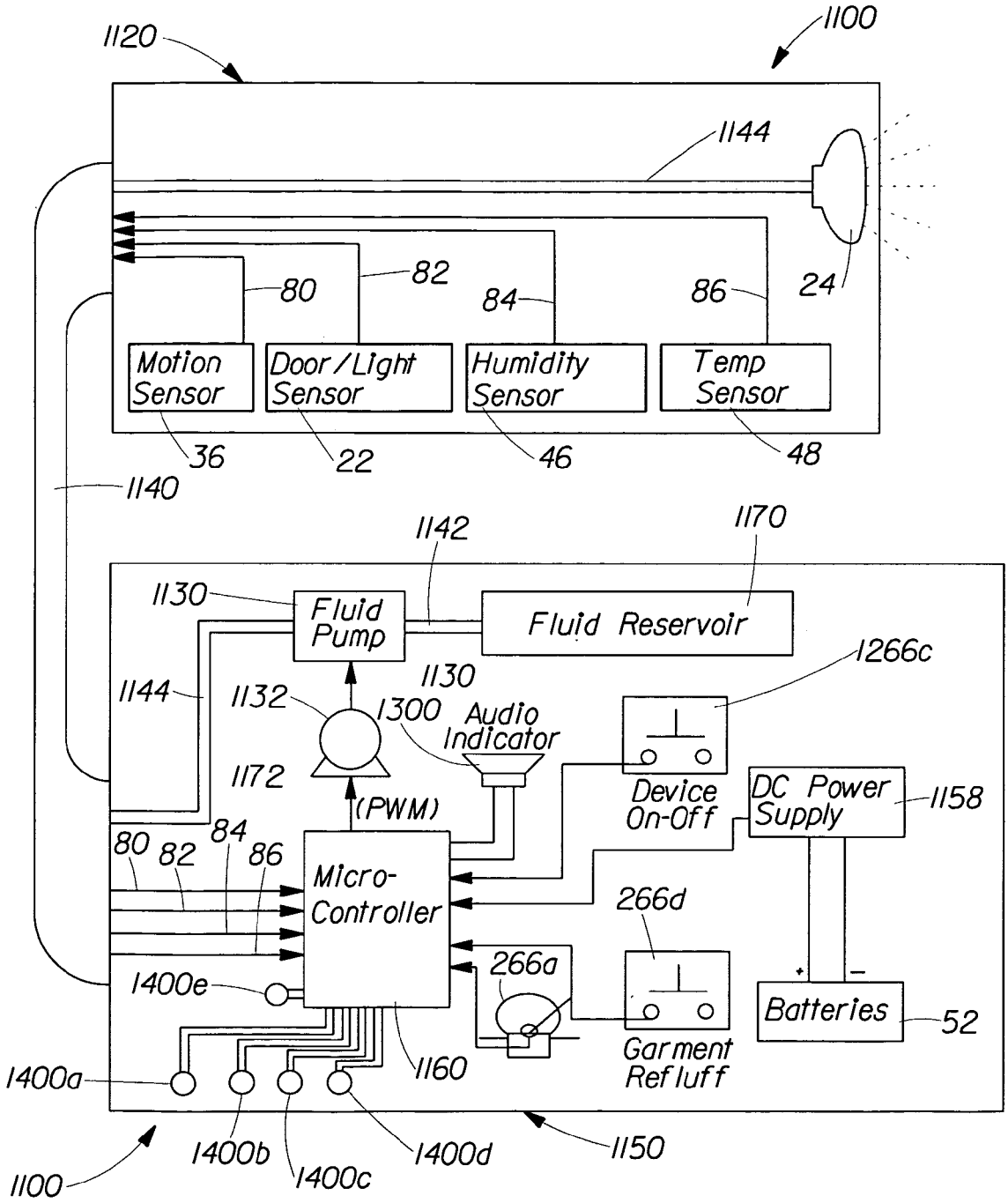
FIG. 14 is a block diagram of at least a portion of the electrical and mechanical components utilized in the unit of FIGS. 11-13.

The cable 1140 carries benefit composition from the fluid pump 1130 in the outer enclosure 1150 to the nozzle 24 in the inner enclosure 1120, see FIG. 14, and electrical signals from the sensors 36, 22, 46 and 48 mounted in the inner enclosure 1120 to a microcontroller 1160 mounted to the printed circuit board 1160*a* in the outer enclosure 1150.

Figure 13:
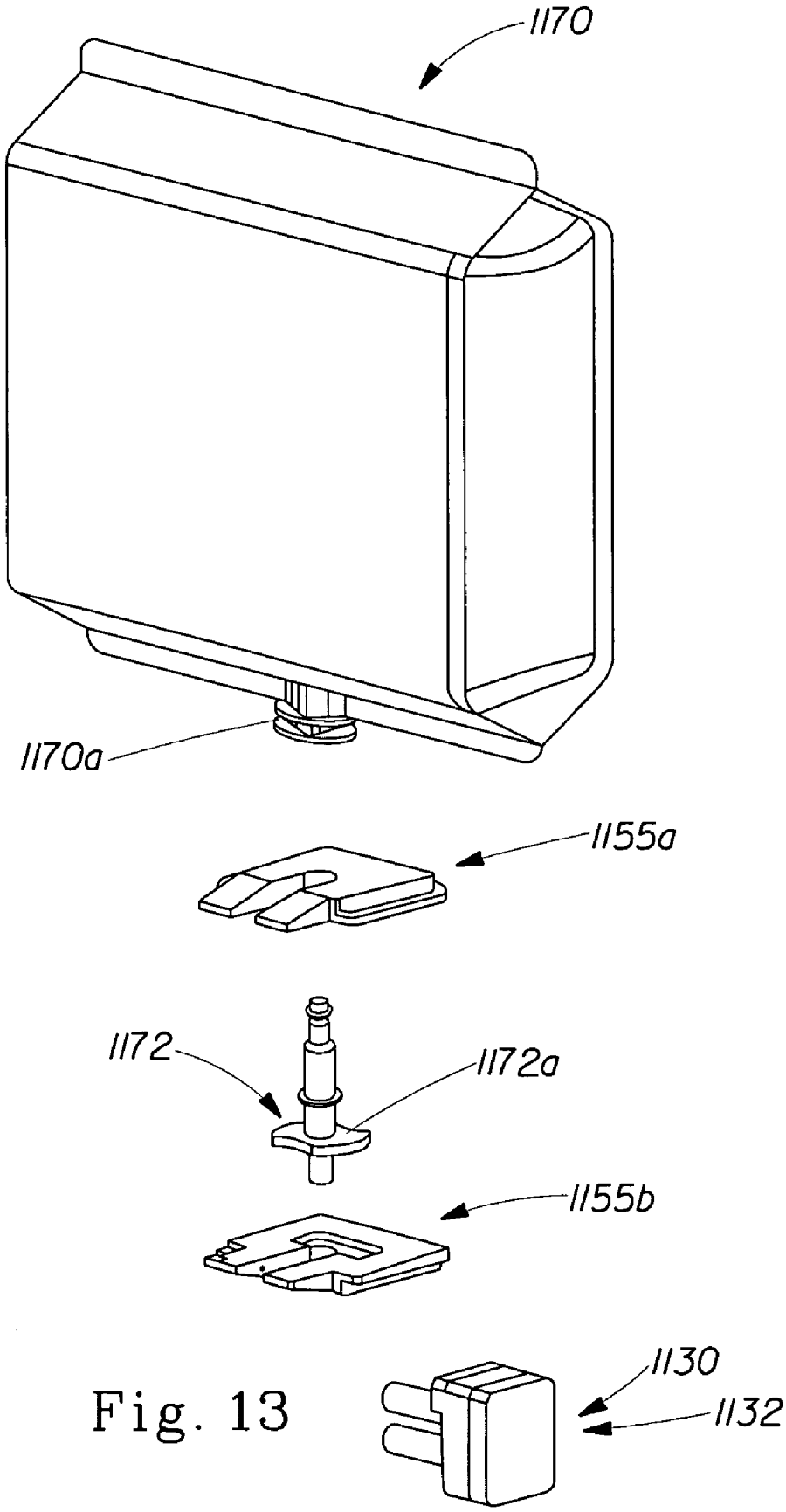
FIG. 13 is an exploded view of the fluid container, the first and second fitments and the first and second mounting shelves.

A first fitment 1172 is mounted to the main body 1151 via first and second mounting shelves 1155*a* and 1155*b*, see FIGS. 12 and 13, and is coupled to the tube or channel 1142 (not shown in FIG. 13), which, in turn, is coupled to the pump 1130. The first and second shelves 1155*a* and 1155*b* are positioned on opposing sides of a flange 1172*a* of the first fitment 1172 and are snap fit, adhesively secured or bolted together so as to encompass the flange 1172*a*. The assembly comprising the shelves 1155*a* and 1155*b* and fitment 1172 is mounted to the main body 1151 such that the shelves 1155*a* and 1155*b* are received within a slot 1151*d* defined in the main body 1151. The fitment 1172 is inserted into a second fitment 1170*a* forming part of the fluid container 1170 when the door 1152 is pivoted to its closed position and functions to pierce or otherwise penetrate the container 1170 so as to provide a pathway for the benefit composition to travel from the container 1170 to the tube 1142. From the tube 1142, the benefit composition travels to the inlet of the pump 1130, after which the composition is pressurized and carried via the tube or channel 1144 (shown in FIG. 12), which extends through the cable 1140, to the discharge nozzle 24, where the benefit composition is discharged. In the illustrated embodiment, the pump 1130 and the motor 1132 comprises a single assembly, namely, a piezoelectric pump, one of which is commercially available from Par Technologies, LLC, under the product designation LPD-30S. Other suitable pumps which can be used in this or other embodiments include but are not limited to gear pumps and diaphragm pumps. One non-limiting example of a suitable diaphragm pump is model No. NF5RPDC-S with a DC motor available from KNF Neuberger, Inc. of Trenton, N.J.

The types of control signals used to control the electric motor 1132 can vary according to the design requirements of the apparatus 1100, and such signals will travel to the motor 1132 via an electrical conductor 1172. In the illustrated embodiment, the electrical signal traveling along conductor 1172 comprises a pulse-width modulated (PWM) signal controlled by the microcontroller 1160. Of course, such a pulse-width modulated signal can also be generated by any appropriate controller or processor, or appropriate discrete logic.

As noted above, the enclosure 1150 comprises a second compartment 1151*c* for storing batteries 52, which may comprise two AA batteries. In the illustrated embodiment, the batteries 52 define a power source, which provide a DC voltage to a DC power supply 1158, see FIG. 14. An example DC power supply comprises an integrated circuit chip commercially available from Maxim Integrated Products under the product designation "MAX1724EZK50-T." The DC power supply 1158 provides an output voltage to the microcontroller 1160.

A suitable microcontroller 1160 is a microprocessor manufactured by Atmel Corporation and sold under the product designation Atmega48-16AI. Alternatively, the microcontroller 1160 may comprise a microprocessor manufactured by Atmel Corporation and sold under the product designation Atmega48-16AJ. Of course, other microcontrollers, microprocessors, controllers, or processors made by different manufacturers, or discrete digital logic could alternatively be used.

The microcontroller 1160 includes on-board memory and input and output lines for analog and digital signals. The microcontroller 1160 also has a serial port that can be interfaced to an optional programmer interface using an RS-232 communications link. As noted above, the ON-OFF switch 1266*c*, and the refluff key 266*d* are coupled to the microcontroller 1160, see FIG. 14. As also noted above, the motion sensor 36, door sensor 22, humidity sensor 46 and temperature sensor 48 generate signals to the microcontroller 1160. As further noted above, the microcontroller 60 generates a pulse-width modulated (PWM) signal to the pump motor 1132 via the conductor 1172. An audio indicator 1300 is further coupled to the microcontroller 1160 and functions to indicate that a drying cycle has been completed, clothes have been treated with the benefit composition, an error occurred during the benefit composition dosing cycle or the benefit composition dispensing apparatus is out of fluid. The audio indicator 1300 is mounted to the printed circuit board 1160, see FIG. 12.

Further coupled to the microcontroller 1160 are first, second, third, fourth and fifth light emitting diodes 1400*a*-1400*e*, see FIGS. 11-13. The diodes are coupled to the face plate 1162 so as to be visible to an operator when actuated, see FIG. 11. The first diode 1400*a* is actuated by the microcontroller 1160 when the apparatus 1100 is activated via the ON-OFF switch 1266*c*. The second diode 1400*b* is actuated by the microcontroller 1160 when the pump 1130 is pumping benefit composition to the nozzle 24. The third diode 1400*c* is actuated by the microcontroller 1160 when the refluff key 266*d* has been activated. The fourth diode 1400*d* is actuated by the microcontroller 1160 when the spraying operation has been completed for the corresponding fabric enhancement operation cycle. The fifth diode 1400*e* is actuated by the microcontroller 1160 to generate a warning signal when the container is out of fluid, or the fabric enhancement cycle has been interrupted, which latter event may be detected via the door sensor 22 sensing light or the motion sensor 36 sensing no motion. The microcontroller 1160 may sense that the container 1170 is out of fluid by sensing a change in the current drawn by the pump motor 1132.

Treatment Composition

A treatment material provides one or more fabric benefits including, but not limited to, softness, anti-soil re-deposition, stain or water repellency, color or whiteness enhancement, fragrance, enhanced absorbency, anti-static, anti-bacterial, wrinkle control, shape/form retention, and/or fabric abrasion resistance. Classes of materials that contain materials that can provide such benefits include, but are not limited to, cationic materials, nonionic materials, other polymeric materials, and particulate materials. Typically, the treatment material is present, based on total composition weight, at one of the following levels, at least about 0.5 wt %, at least about 2 wt %, from about 4 wt % to about 90 wt %, from about 4 wt % to about 50 wt %, or from about 4 wt % to about 10 wt %. Suitable treatment materials include but are not limited to those disclosed in WO 2004/12007, published on Nov. 4, 2004 and entitled "Volatile Material Delivery Method"; WO 00/24856, published on May 4, 2000 and entitled "Fabric Care Composition and Method"; U.S. patent application Publication No. 2005/0022311 published on Feb. 3, 2005 and entitled "Fabric Article Treating System and Method"; U.S. patent application Publication No. 2005/0076534, published on Apr. 14, 2005 and entitled "Fabric Article Treating Device and System with Static Control".

The fabric treatment composition used in conjunction with the present invention may include a perfume. The perfume may comprise at least about 0.005 wt. %, about 0.005 wt. % to about 10 wt % or about 0.1 wt. % to about 2 wt. % of a material such as a perfume that comprises at least about 30 wt. %, about 35 wt % to about 100 wt. %, about 40 wt % to about 100 wt. % or about 40 wt % to about 70 wt. % of a perfume material having a boiling point of less than or equal to about 250° C. at 1 atmosphere; a fabric treatment material; an optional carrier and the balance being one or more adjunct ingredients such as disclosed in copending application WO 2004/12007.

The fabric treatment composition used in conjunction with the present invention may also include from about 0.5 to about 20% of fabric softeners or fabric hand modifiers non-limiting examples of which include diester quaternary ammonium compounds, polyquaternary ammonium compounds, triethanolamene esterified with carboxylic acid and quaternized materials, amino esterquats, cationic diesters, betain esters, betaines, silicone or silicone emulsions comprising amino silicones, cationic silicones, quat/silicone mixtures, functionalized polydimethyl siloxanes ("PDMS"), amine oxides, silicone co-polyols, cationic starches, sucrose fatty esters, polyethylene emulsions, and mixtures thereof.

The fabric treatment composition used in conjunction with the present invention may also include from about 0.1 to about 1.2% of antistatic agents non-limiting examples of which include polyanilines, polypyrroles, poly acetylene, polyphenylene, polythiophenes, ethoxylated polyethyleneimines, and various commercial materials such as STATEXAN WP, STATEXAN HA, or STATEXAN PES (available from LanXess—a subsidiary of Bayer located in Leverkusen, Germany), ETHOFAT (available from Akso Nobel of Arnhem, Netherlands), and mixtures thereof.

The fabric treatment composition used in conjunction with the present invention may also include from about 0.005 to about 1.5% of malodor control agents non-limiting examples of which include substituted or unsubstituted cyclodextrins, porous inorganic materials, starch, olfactory odor blockers and mixtures thereof.

The fabric treatment composition used in conjunction with the present invention may also include from about 0.05 to about 0.5% of preservatives non-limiting examples of which include didecyl dimethyl ammonium chloride which is available under the tradeneme UNIQUAT® (from Lonza of Basel Switzerland), 1,2-benzisothiozolin-3-one, which is available under the tradename PROXEL® (from Arch Chemicals of Norwalk, Conn.), dimethylol-5,5-dimethylhydantoin which is available under the tradeneme DANTOGUARD® (from Lonza of Basel Switzerland), 5-Chloro-2-methyl-4-isothiazolin-3-one/2-methyl-4-isothiazolin-3-one, which is available under the tradename KATHON® (from Rohm and Haas of Philadelphia, Pa.), and mixtures thereof.

The fabric treatment composition used in conjunction with the present invention may also include from about 0.05 to about 5% of ethoxylated surfactants and/or emulsifiers. These may include, but are not limited to carboxylated alcohol ethoxylates, ethoxylated quaternary ammonium surfactants, ethoxylated alkyl amines, alkyl phenol ethoxylates, alkyl ethoxylates, alkyl sulfates, alkyl ethoxy sulfates, polyethylene glycol/polypropylene glycol block copolymers, fatty alcohol and fatty acid ethoxylates, long chain tertiary amine oxides, alkyl polysaccharides, polyethylene glycol ("PEG") glyceryl fatty esters and mixtures thereof.

Processes of Making Fabric Treatment Compositions

The fabric treatment compositions of the present invention can be formulated into any suitable form and prepared by any process chosen by the formulator, non-limiting examples of which are described in U.S. Pat. No. 6,653,275.

Uniformity and Deposition Efficiency

It is desirable that a treatment composition applied during the drying process be uniformly distributed onto the fabric in the tumble dryer during the drying process. It is also desirable during the drying process that a treatment composition be deposited on the fabric that is in the tumble dryer rather than deposited elsewhere such as through the dryer vent/lint screen. While not wishing to be limited by theory it is believed that some factors which may possibly influence both uniformity of distribution and deposition of the treatment composition onto the fabric in the drum of the tumble dryer include flowrate of the treatment composition in the drum, the droplet size of the treatment composition, the position of the spray in the drum, the cone angle of the spray in the drum, the linear velocity of the treatment composition in the drum.

In accordance with the present invention, it is desirable that the uniformity of distribution (i.e.; Distribution Index) of the treatment composition on the fabric in the drum of the tumble dryer be at least about 35%, at least about 45%, at least about 50%, at least about 60%, at least about 70%, at least about 75%, or at least about 80%. It is desirable that the deposition of the treatment composition onto the fabric in the drum of the tumble dryer be at least about 70%, at least about 75%, or at least about 80%. It is also desirable that less than about 10% of the treatment composition be released from the dryer drum through the lint screen, less than about 5% of the treatment composition be released from the dryer drum through the lint screen, or less than about 1% of the treatment composition be released from the dryer drum through the lint screen.

Method for Determining Cone Angle of a Spray

The following method may be used to measure the cone angle (width of a spray).

1. Measure the depth of the dryer drum to which the spray is to be applied. Calculate the distance that is 20% of the total length of the dryer drum depth.

2. The sprayer which is to be the source of the spray is mounted on a vertical surface at the height that corresponds to the vertical midpoint of the dryer drum with the nozzle of the spraying device aligned with the corresponding horizontal (perpendicular) axis.

3. Assemble a Photron Fastcam PCI 2KC available from Motion Engineering of Indianapolis, Ind. in conjunction with a Magma CB2 and Dell Inspiron 8100. Assemble a halogen lamp to provide additional light when filming. Use a 25 mm lens to video tape the spray with high resolution. Align the video camera such that the field of view includes the discharge of the nozzle and extends to at least the 20% distance calculated in step 1. Further, insure that the camera is aligned to capture the widest angle of the spray.

4. Activate the spray in the absence of dryer airflow.

5. Video tape the fluid spray at 1000 frames per minute against a black background.

6. Insert single frame pictures of the spray into Microsoft Visio wherein the pictures are zoomed in to 400%

7. To determine the cone angle using the picture from step 6, draw the vertical line corresponding to the point that is 20% of the length determined in step 1 so as to intersect the top and bottom boundaries of the spray. From the point where the vertical line intersects the top boundary of the spray, draw a line back to the discharge midpoint of the nozzle of the sprayer. Repeat this process for the lower boundary of the spray (i.e.; from the point where the vertical line intersects the bottom boundary of the spray, draw a line back to the discharge midpoint of the nozzle of the sprayer. The cone angle is the internal angle formed by the intersection of these two lines at the nozzle discharge.

Method for Determining Deposition of the Treatment Composition on the Fabric and Deposition of the Treatment Composition on the Lint Screen Fabric Stripping:

1. Weigh fabrics until the total load weight is approximately 2.7 kg.
2. Turn on the washing machine set on a 10-min. agitation time and a high water level, approximately 21 gal fill.
3. Use approximately 160 grams of a liquid laundry detergent such as Liquid TIDE®.
4. Add the detergent to the washing machine water after it is approximately ¼ full. Rinse the laundry detergent bottle cap out with water running into the machine so as to allow any remaining detergent in the cap to run into the washing machine.
5. Once the tub is filled to approximately ¾ full, the fabrics are added to the water in the washing machine.
6. The wash cycle is allowed to proceed automatically through completion of the final spin.
7. Steps #2-6 are repeated 3 more times, with the respective amounts of detergent added to the wash load as listed above.
8. After the $4^{th}$ cycle is complete, the fabrics are removed from the washing machine and dried using the high heat cycle of a dryer.
9. The fabrics are then stored in plastic bags until treatment.

Fabric Treatment:

Fabric Load—Each treatment consists of using twelve 1 yd. squares of stripped fabric swatches per load.

Treatment Process—The stripped fabric swatches are placed in the washing machine, set on the rinse cycle, wet and spun dry.

Before placing damp fabrics into the tumble dryer, the following Dryer Cleaning Procedure is performed before each treatment. A 5% bleach solution is sprayed inside the dryer on the front and back walls and the dryer drum. The lint screen is removed prior to spraying. The dryer is thoroughly wiped down with paper towels. Once dryer cleaning is complete, the lint trap of the dryer is replaced and covered with a new 14" by 7" piece of white cotton knit fabric secured on the edges by masking tape. A suitable white cotton knit fabric is CW120 available from Empirical Manufacturing Company of Cincinnati, Ohio. The damp fabrics are then placed into the dryer drum, and a drying cycle is completed. During the drying cycle, a spray composition is delivered into the dryer drum. Following the drying treatment cycle, the fabrics are removed from the dryer drum as is the covering over the lint screen for sampling and analysis.

Fabric Sampling:

Lint Screen—The fabric over the lint screen is sampled as follows:

1. The covering over the lint screen is sampled by removing it from the lint screen.
2. Six circular samples measuring 40 mm in diameter are cut from the portion of the lint screen cover which was not covered by the masking tape.
3. The six samples cut from the lint screen cover are labeled and analyzed according to the swatch analysis described below.

Fabric Load (from the dryer)—

1. Six of the twelve, one square yards of fabric are sampled from each cycle.
2. Each fabric swatch is unfolded and a ruler used to measure in six inches from the corner of the swatch.
3. A 40 mm circle is cut from this area.
4. Sample swatches are labeled and analyzed.

Swatch Analysis:

Inductively Coupled Plasma Optical Emission Spectrometry (ICP) is used to analyze the samples. In order to determine spray performance, Yttrium (Y) is spiked into the treatment composition solution as a tracer element. Add 200 ppm of Y into the treatment composition to be tested. Spray the composition onto the fabric to be tested. After spraying, cut samples from the fabric. Digest the fabric samples via high pressure microwave to get into acidic solution. Calibrate ICP for quantitative Y determination. Measure Y in solution. Back calculate for amount of Y on fabric and apply stoichiometric correction to determine amount of treatment composition solution on the fabrics. The distribution of Y is representative of the distribution of the treatment composition solution.

Method for Determining Uniformity of the Treatment Composition (Distribution Index) onto the Fabric Image analysis may be used to evaluate uniformity of spray distribution per surface area of a test sample. A number of digital images are acquired per sample by imaging equipment and analyzed by computer software. The software detects a spray deposition area and provides a count of the number of pixels comprising the stained areas in the image. By comparison of the number of pixels detected for all images taken per sample, a standard deviation is calculated. A smaller standard deviation correlates to a more uniform spray deposition. In order to determine spray uniformity, a fabric sample is sprayed with red dye (i.e.; 0.0 wt 5% FD&C Red Dye #40 in distilled water).

Image analysis is then conducted according to the following steps to evaluate the uniformity of distribution of spray on a sample.

(1) Background Calibrate Imaging System and Acquire Digital Image of Sample

Background calibration, a well known technique for calibrating images using a flat neutral gray card, is applied to images before analysis to eliminate lighting variance across the field of view and minimize problems in image analysis due to spatial lighting variance.

Additionally, to insure color consistency in the digital images taken at different times (e.g. images taken on different days), the images are also color corrected using a standard color chart (Gretag Macbeth 24 color chart).

After calibrating the background, place the fabric to be tested in a light booth and fold such that the particular area to be imaged is at the center of the light booth directly between the lamps and facing upwards towards the camera. A stencil in the size of the field of view of the camera (16 cm by 20.5 cm) is placed on the area to be imaged. A picture is taken in response to a command from the operator when the sample is correctly positioned. Six images are taken per front-side and back-side of the fabric for a total of 12 images per fabric.

The picture is digitized (i.e. converted to a binary representation) in a known manner. Finally, the digital image data is transferred to a computing device. Many other methods of acquiring the digital image are well known to persons of ordinary skill in the art. For example, a sample to be analyzed may be submitted via the network, a file may be retrieved from a database, and/or a flatbed scanner may be used to digitize a photograph.

(2) Electronically Analyze the Digital Image to Detect the Areas of Spray Deposition The image is electronically processed by image analysis software (Optimas v6.5 available from Media Cybernetics, Incorporated of Silver Spring, Md.) based on a reference intensity threshold. The region of interest selected is the entire screen image. The method for selecting the intensity threshold setting is as follows. The background and color corrected images of the fabric (step 1 above) are converted to a single 'gray' level image representation that highlights the difference between the red dyed areas and 'clean' fabric areas. The method used depends upon the lighting, imaging system, and type and color of dye used vs. the background fabric color. For example the green channel can be used. Related approaches can also be used, for example, an intensity image from Red—Green, Red—Blue or other similar mathematical combinations of the Red, Green, and Blue color channels of an image can be used to create a single channel 'gray' level image for thresholding that accentuates the differences between the dyed and 'clean' areas of the fabric.

The software is calibrated to detect colored areas in pixels of the digital images. To set the threshold for pixel detection, a "clean", un-dyed white fabric is the standard reference and is imaged according to step (1). After converting to a single channel 'gray' level image representation, the threshold is set for which zero pixels are detected for all images for that "clean" sample, and such that increasing the threshold value any higher would make the software start detecting pixels on the "clean" sample. Pixels of a color intensity value within the set threshold are detected and counted by the image analysis software.

(3) Calculate Standard Deviation in Percent of Pixels Detected for All Images Per Sample The percent of pixels detected per area is obtained by mathematical calculation using the number of pixels detected divided by the number of total pixels per image. Therefore for each fabric analyzed, there are twelve values of percent of pixels detected. For the twelve images per fabric, the standard deviation of percent of pixels detected is obtained by mathematical calculation, according to $$\sigma = \sqrt{\frac{\sum_i (X - \mu)^2}{N - 1}}$$

where

σ=standard deviation $X_i$=percent of pixels detected per image

μ=average value of the percent of pixels

N=number of values in the set of measurements

To more conveniently compare the uniformity of spray deposition across fabrics, treatments, and the like, a Distribution Index is created by a mathematical equation using the standard deviation value. This distribution index is a scale from 0 to 100.

0<Distribution Index≦100

$$\text{Distribution Value} = \frac{1}{(\sigma + 1)} \times 100$$

Wherein a higher distribution value correlates to a more uniform sample.

EXAMPLES

Example Treatment Composition

The following are non-limiting examples of treatment compositions which may be useful in the present invention:

| | Weight % | | | | | | | |
|---|---|---|---|---|---|---|---|---|
| CHEMICAL NAME | A | B | C | D | E | F | G | H |
| Di-tallowoylethanolester dimethylammonium chloride | 6.500 | | | | | | | 2.17 |
| Sucrose fatty ester | 2.000 | | | | | | | 0.67 |
| Propylene glycol n-butyl ether | 2.000 | | | | | | | 2.00 |
| Propylene Glycol | 4.000 | | | | | | | 4.00 |
| Diethylene Glycol | | 0.10 | 0.10 | 0.10 | 0.10 | 0.10 | | |
| Hydrogenated castor oil | | 0.20 | 0.20 | 0.20 | 0.20 | 0.20 | 0.20 | |
| Ethoxylated polyethyleneimine | | 0.50 | 0.50 | 0.50 | 0.50 | 0.50 | 0.50 | |
| Phenoxyethanol | 0.100 | | | | | | | 0.10 |
| Preservatives | 0.10 | 0.10 | 0.10 | 0.10 | 0.10 | 0.10 | 0.10 | 0.10 |
| Stabilizers | 0.100 | 0.20 | 0.20 | 0.20 | 0.20 | 0.20 | 0.20 | 0.20 |
| Perfume | 0.350 | 0.35 | 0.35 | 0.35 | 0.35 | 0.35 | 0.35 | 0.35 |
| Poly(oxy)ethylene | 0.035 | | | | | | | 0.035 |
| Lactic Acid | 0.100 | | | | | | | 0.10 |
| CaCl2-6H2O | 0.210 | | | | | | | 0.21 |
| Silicone co-polyol* Silwet L7600 | 0.100 | | | | | | | 0.10 |
| Silwet L7608 | | 0.05 | 0.05 | 0.05 | | | 0.05 | |
| Silwet L 7001 | | 1.25 | 2.50 | 2.50 | 1.00 | | 1.25 | |
| Acetylenic diols | | | | | | | | 1.00 |
| Polyethylene microemulsion | | | | | 0.25 | 1.25 | | |
| Hydroxy propyl cyclodextrin | | 0.25 | 0.25 | | 0.25 | 0.25 | 0.25 | |
| Deionized Water | Balance | Balance | Balance | Balance | Balance | Balance | Balance | Balance |
| TOTAL | 100% | 100% | 100% | 100% | 100% | 100% | 100% | 100% |

| | Weight % | | | | | | |
|---|---|---|---|---|---|---|---|
| CHEMICAL NAME | I | J | K | L | M | N | O |
| Di-tallowoylethanolester dimethylammonium chloride | | 1.00 | 2.17 | 12.00 | | | |
| Sucrose fatty ester | | 0.35 | 0.67 | 4.00 | | | |
| Propylene glycol n-butyl ether | | | | | | | |
| Propylene Glycol | | | | | | | |
| Diethylene Glycol | | | | | 0.10 | 0.10 | |
| Hydrogenated castor oil | 0.20 | 0.10 | | | 0.20 | 0.40 | 0.40 |
| Ethoxylated polyethyleneimine | 0.50 | | | | 1.00 | 0.50 | 0.50 |
| Phenoxyethanol | | 0.10 | 0.10 | 0.200 | | | |
| Preservatives | 0.10 | 0.10 | 0.10 | 0.10 | 0.10 | 0.10 | 0.10 |
| Stabilizers | 0.20 | 0.20 | 0.20 | 0.100 | 0.20 | 0.20 | 0.20 |
| Perfume | 0.35 | 0.35 | 0.35 | 0.700 | 0.35 | 0.70 | 0.70 |
| Poly(oxy)ethylene | | 0.035 | 0.035 | 0.50 | | | |
| Lactic Acid | | 0.10 | 0.10 | 0.100 | | | |
| CaCl2-6H2O | | 0.10 | 0.21 | 0.210 | | | |

-continued

| | | | | | | | |
|---|---|---|---|---|---|---|---|
| Silicone co-polyol* | | | 0.10 | | | | |
| Silwet L7600 | | | | | | | |
| Silwet L7608 | 0.05 | 0.05 | | | 0.05 | 0.05 | 0.05 |
| Silwet L 7001 | 0.50 | 0.65 | | | 1.25 | 1.25 | 1.25 |
| Acetylenic diols | | 1.00 | 1.00 | 1.00 | | | |
| Polyethylene microemulsion | 0.75 | | | | | | |
| Hydroxy propyl cyclodextrin | 0.25 | | | | 0.25 | 0.25 | 0.25 |
| Deionized Water | Balance | Balance | Balance | Balance | Balance | Balance | Balance |
| TOTAL | 100% | 100% | 100% | 100% | 100% | 100% | 100% |

Example Nozzle Placements

The following are non-limiting examples of nozzle placements which may be used in a tumble dryer:

A. Non-limiting examples of nozzle placements which may be used with a cross-flow tumble dryer (i.e.; where the drum typically rotates in a counter-clockwise motion, and air flow typically enters the tumble dryer through a rear panel in quadrant 602 and exits through the rear panel of the dryer in quadrant 601—see FIG. 1).

| | Example | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Number of nozzles | 1 | 1 | 1 | 1 | 1 | 1 | 1 | 1 | 2 | 2 | 1 | 1 | 2 |
| Dryer panel[1] | F | F | F | F | F | F | F | F | F | F | B | B | F/B |
| Quadrant[2] | O | O | O | 2 | 2 | 3 | 3 | 1 | 1/2 | 2/4 | 2 | O | 2/O |
| Vertical displacement[3] (%) | 0 | 0 | 0 | 40 | 10 | 30 | 5 | 30 | 15/30 | 40/20 | 30 | 0 | 25/0 |
| Horizontal displacement[4] (%) | 0 | 0 | 0 | 20 | 30 | 10 | 5 | 20 | 10/15 | 40/5 | 10 | 0 | 20/0 |
| Nozzle angle (degrees up ("U") or down ("D")) | 0 | 30 D | 15 U | 45 D | 0 | 10 U | 55 U | 30 D | 45/15 D/D | 0/15/U | 25 D | 5 D | 15/15 D/D |
| Nozzle angle (degrees left ("L") or right ("R"))[5] | 0 | 20 L | 55 L | 15 R | 5 R | 15 R | 25 L | 45 L | 45/0 L/ | 30/45 R/L | 10 R | 15 L | 0/10/L |

[1]Denotes nozzle placement on the front ("F") panel/door of the tumble dryer or back ("B") panel of the tumble dryer.
[2]Abbreviated as follows: Referring to FIG. 1, "O" refers to the intersection of line 640 with line 630. The number "1" refers to the first quadrant 601. The number "2" refers to the second quadrant 602. The number "3" refers to the third quadrant 603. The number "4" refers to the fourth quadrant 604.
[3]Expressed as % of the total distance from the intersection of lines 630 and 640 to the edge of the dryer drum (i.e.; the radius) when measured from the intersection of line 630 and line 640 along line 640 in the direction required to land in the designated quadrant.
[4]Expressed as % of the total distance from the intersection of lines 630 and 640 to the edge of the dryer drum (i.e.; the radius) when measured from the intersection of line 630 and 640 along line 630 in the direction required to land in the designated quadrant.
[5]Referenced as viewed from the front side of the dryer.

B. Non-limiting examples of nozzle placements which may be used with an axial flow dryer (i.e.; where the drum typically rotates in a clockwise motion and air flow typically enters the dryer through the rear panel of the appliance in the first quadrant 601 of FIG. 1 and exits through the lint screen in the front panel of the dryer below the door).

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Number of Nozzles | 1 | 1 | 1 | 1 | 1 | 1 | 1 | 1 | 1 | 1 | 2 | 2 | 1 | 1 |
| Dryer panel[1] | F | F | F | F | F | | F | F | F | F | F | F/B | B | B |

-continued

| | Example | | | | | | | | | | | | | |
|---|---|---|---|---|---|---|---|---|---|---|---|---|---|---|
| | 1 | 2 | 3 | 4 | 5 | 6 | 7 | 8 | 9 | 10 | 11 | 12 | 13 | 14 |
| Quadrant[2] | O | O | O | 1 | 1 | 1 | 2 | 2 | 3 | 4 | 1/2 | 1/1 | 2 | O |
| Vertical displacement[3] (%) | 0 | 0 | 0 | 30 | 15 | 5 | 40 | 5 | 10 | 10 | 25/10 | 40/15 | 20 | 0 |
| Horizontal displacement[4] (%) | 0 | 0 | 0 | 40 | 20 | 5 | 20 | 5 | 20 | 20 | 10/15 | 20/10 | 10 | 0 |
| Nozzle angle (degrees up (U) or down (D)) | 0 U | 55 D | 55 D | 35 D | 0 | 15 U | 30 D | 10 D | 55 U | 45 U | 0/15/D | 15/0 D/ | 20 U | 15 D |
| Nozzle angle (degrees left (L) or right (R))[5] | 0 | 55 R | 0 | 45 L | 30 L | 0 | 40 R | 10 R | 15 R | 35 L | 0/45/R | 30/5 L/R | 15 R | 25 R |

[1]Denotes nozzle placement on the front ("F") panel/door of the tumble dryer or back ("B") panel of the tumble dryer.
[2]Abbreviated as follows: Referring to FIG. 1, "O" refers to the intersection of line 640 with line 630. The number "1" refers to the first quadrant 601. The number "2" refers to the second quadrant 602. The number "3" refers to the third quadrant 603. The number "4" refers to the fourth quadrant 604.
[3]Expressed as % of the total distance from the intersection of lines 630 and 640 to the edge of the dryer drum (i.e.; the radius) when measured from the intersection of line 630 and line 640 along line 640 in the direction required to land in the designated quadrant.
[4]Expressed as % of the total distance from the intersection of lines 630 and 640 to the edge of the dryer drum (i.e.; the radius) when measured from the intersection of line 630 and 640 along line 630 in the direction required to land in the designated quadrant.
[5]Referenced as viewed from the front side of the dryer.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention. All documents cited herein are, in relevant part, incorporated herein by reference. The citation of any document is not to be construed as an admission that it is prior art with respect to the present invention.

What is claimed is:

1. A system for spraying fabric in a fabric article drying appliance, the system comprising:

a) a tumble dryer having a rotating drum;

b) a treatment composition;

c) a controller; and d) a pump, the pump comprising:

i) a conduit wherein the conduit includes an inlet and a discharge for transferring the treatment composition from the inlet of the conduit to the discharge of the conduit; and ii) a nozzle having at least one orifice wherein the size of the orifice nozzle is between about 200 microns to about 600 microns wherein the nozzle is connected to the discharge of the conduit;

whereby the controller controls the spraying of the treatment composition through the nozzle so as to spray onto fabric in the tumble dryer while the tumble dryer drum is rotating, the spray being characterized by a cone angle and having:

i) a mean droplet size of the treatment composition of about 100 microns to about 1000 microns;

ii) a cone angle formed by the spray in the tumble dryer between about 35° to about 150°;

iii) a flowrate at the point the spray enters the tumble dryer of about 0.5 ml/min to about 100 ml/min;

iv) a linear velocity at the point the spray enters the tumble dryer of about 0.5 m/second to about 20 m/second; and wherein the nozzle is positioned into the tumble dryer such that it is either in quadrant one, quadrant two, quadrant three, or quadrant four, and wherein the nozzle when present in quadrant one has a tilt angle ranging from about 80 to the left to about 45° to the right and from about 45° up to about 35° down; when present in quadrant two the nozzle has a tilt angle ranging from about 80° to the right to about 45° to the left and from about 45° up to about 15° down; when present in quadrant three the nozzle has a tilt angle ranging from about 80° to the right to about 45° to the left and from about 45° up to about 15° down; and when present in quadrant four the nozzle has a tilt angle ranging from about 80° to the left to about 15° to the right and from about 45° up to about 15° down.

2. The system of claim 1 wherein the treatment composition has a Brookfield viscosity of about 200 cps or less as measured at a temperature of approximately 24° C. using an LVI spindle.

3. The system of claim 1 wherein the treatment composition has a surface tension of about 3 to about 100 dynes/cm as measured between about 20° C. to about 25° C.

4. The system of claim 1 wherein the treatment composition is a perfume, an anti-static agent, a fabric hand modifier, or a combination thereof.

5. The system of claim 1 wherein the nozzle further comprises a deflector.

* * * * *